US005948334A

United States Patent [19]

Takeuchi et al.

[11] Patent Number: 5,948,334

[45] Date of Patent: Sep. 7, 1999

[54] COMPACT LONG SPIN SYSTEM

[75] Inventors: Kunihiko Takeuchi, Conyers; Clayton E. Torrence, Covington; Donald J. Pederson, Lithonia, all of Ga.; Walter R. Curfman, Wilmington, Del.; Shiv Sibal, Conyers; Michael P. Hegwood, Social Circle, both of Ga.; Dwayne S. Weaver, Covington, Ga.

[73] Assignee: Fiberco, Inc., Wilmington, Del.

[21] Appl. No.: 08/903,877

[22] Filed: Jul. 31, 1997

[51] Int. Cl.[6] ..... D01F 6/04; D01F 6/06; D01F 11/04

[52] U.S. Cl. ..... 264/83; 264/211.12; 264/211.14; 264/211.17; 264/237

[58] Field of Search ..... 264/83, 211.12, 264/211.14, 211.17, 237

[56] References Cited

U.S. PATENT DOCUMENTS

| | | | |
|---|---|---|---|
| 4,626,467 | 12/1986 | Hostetter . | |
| 4,938,832 | 7/1990 | Schmalz . | |
| 4,943,220 | 7/1990 | Fourne . | |
| 5,045,387 | 9/1991 | Schmalz . | |
| 5,277,859 | 1/1994 | Slack et al. | 264/211.12 X |
| 5,281,378 | 1/1994 | Kozulla . | |
| 5,318,735 | 6/1994 | Kozulla . | |
| 5,403,426 | 4/1995 | Johnson et al. . | |
| 5,431,994 | 7/1995 | Kozulla . | |
| 5,485,662 | 1/1996 | Hodges, Jr. et al. . | |
| 5,540,953 | 7/1996 | Harrington . | |
| 5,629,080 | 5/1997 | Gupta et al. . | |
| 5,660,789 | 8/1997 | Spagnoli et al. . | |
| 5,705,119 | 1/1998 | Takeuchi et al. . | |

FOREIGN PATENT DOCUMENTS

| | | |
|---|---|---|
| 0445536 | 9/1991 | European Pat. Off. . |
| 0486158 | 5/1992 | European Pat. Off. . |
| 0552013 | 7/1993 | European Pat. Off. . |
| 0629720 | 12/1994 | European Pat. Off. . |
| 0630996 | 12/1994 | European Pat. Off. . |
| 0719879 | 7/1996 | European Pat. Off. . |
| 19700169 | 7/1997 | Germany . |
| 95/10645 | 4/1995 | WIPO . |
| 97/37065 | 10/1997 | WIPO . |
| 98/15685 | 4/1998 | WIPO . |

OTHER PUBLICATIONS

Nakajima et al.., in "Advanced Fiber Spinning Technology,", Woodhead Publishing Ltd., 1994, pp. 49–53.

Fujimoto et al., Seni–Gakkaishi, vol. 44, No. 10 (1988), pp. 477–482.

*Primary Examiner*—Leo B. Tentoni

*Attorney, Agent, or Firm*—Greenblum & Bernstein P.L.C.

[57] ABSTRACT

Process and apparatus for the manufacture of polyolefin-containing fibers, preferably high-smectic content polyolefin-containing fibers, wherein a spin height of less than about 4 meters is utilized at spinning speeds of at least about 500 m/min. Further, guidance wings and/or an exhaust extensions are disclosed for various spinning systems to assist in the quenching of fibers. Fibers produced by the invention, preferably skin-core fiber, enable the production of nonwoven materials having excellent properties.

47 Claims, 7 Drawing Sheets

COMPACT LONG SPIN SYSTEM

BACKGROUND OF THE INVENTION

1. Field of the Invention

The present invention generally relates to polyolefin fibers such as fibers comprising polypropylene. In particular, the present invention relates to processes and apparatus for the production of polyolefin fiber. The present invention also relates to fibers produced using compact long spin processes and apparatus, and to articles incorporating these fibers.

2. Background

The production of polymer fiber and filaments usually involves the use of a single polymer or blend of polymers optionally mixed with nominal amounts of stabilizers, pigments and/or other additives such as Elvax® or Kemamine®. The mix is extruded into fibers and fibrous products using conventional commercial processes. Nonwoven fabrics are typically made by making a web comprising continuous or staple fibers and bonding the fibers together. For instance, staple fibers may be converted into nonwoven fabrics using, for example, a carding machine, and the carded web is then bonded, e.g., thermally bonded, by any of various techniques, including those utilizing heated rollers, lasers or ultrasonic welding.

Production of fibers through melt extrusion is generally done in either a two-step "long spin" process, or a one-step "short spin" process. The long spin process for polypropylene involves first melt-extruding fibers at typical spinning speeds of about 500 to 3,000 m/min, and more usually from about 500 to 1,500 m/min. The hot extrudate is quenched to form filaments and optionally coated with a finish. These quenched filaments are then collected on, or redirected by, a take-up roll. The spin height, i.e., the vertical distance from the spinnerette to the take-up roll, is typically about 6 m or more in the traditional long spin process. Additionally, in a second step of the draw process, usually run at about 100 to 500 m/min, these fibers may be drawn, crimped, and/or cut into staple fiber.

In contrast, the one-step short spin process involves conversion from bulk polymer to staple fibers in a single step where typical spinning speeds are in the range of about 50 to 200 m/min. The productivity of the short spin process is increased with the use of about 5 to 20 times the number of capillaries in the spinnerette compared to that typically used in the long spin process. For example, while each spinnerette in a typical commercial long spin process might include about 50 to 4,000 capillaries, preferably about 700 to 3,500 capillaries, spinnerettes for a typical commercial short spin process would include about 5,000 to 120,000 capillaries, preferably about 15,000 to 70,000 capillaries. The distance from the spinnerette to the take-up roll in the short spin process is typically about 2 m. When either process is used in the production of bi- or other multi-component filaments, the number of capillaries refers to the number of filaments being extruded, and usually not the number of holes for polymer extrusion in the spinnerette.

The short spin process for the production of fiber is also significantly different from the long spin process in terms of the quenching conditions needed for spin continuity. For example, in a short spin process performed at a spinning speed of about 200 m/min and including a short take-up distance and high hole density spinnerettes, a high quench air velocity, about 900 to 2,500 m/min, is required to complete the fiber quenching within about 2–3 cm of the spinnerette face. In contrast, in the long spin process, with spinning speeds of about 1,000 to 1,500 m/min for polypropylene filament, a much lower quench air velocity in the range of about 60 to 155 m/min is used.

A number of modern uses have been found for nonwoven materials produced from melt spun filaments, such as those produced from a long spin process described above. The filament thus formed may be cut into staple fiber and formed into nonwoven fabrics or used as filler material. Alternatively, the fiber or filament may be used as a continuous fiber or filament in woven or nonwoven fabrics. Other uses of these filaments are known to those of ordinary skill in the art and will not be detailed here. Many of these uses demand special properties of the fiber and corresponding nonwoven fabric, such as special fluid handling, high vapor permeability, softness, strength, integrity and durability. Also, the processing techniques are desired to be efficient and cost effective.

Various techniques are known for producing fibers that are able to be formed into nonwoven materials having superior properties, including high cross-directional strength and softness. For example, U.S. Pat. Nos. 5,281,378, 5,318,735 and 5,431,994 to Kozulla. and European Patent Application No. 719 879 A2 (published Mar. 7, 1996), assigned to Hercules Incorporated, which are incorporated by reference as if set forth in their entireties herein, are directed to processes for preparing polypropylene containing fibers by extruding polypropylene containing material having a broad molecular weight distribution to form a hot extrudate having a surface, with quenching of the hot extrudate in an oxygen-containing atmosphere being controlled so as to effect oxidative chain scission degradation of the surface. In one aspect of the process disclosed in the Kozulla patents, the quenching of the hot extrudate in an oxygen-containing atmosphere can be controlled so as to maintain the temperature of the hot extrudate above about 250° C. for a period of time to obtain oxidative chain scission degradation of the surface.

As disclosed in these patents, by quenching to obtain oxidative chain scission degradation of the surface, such as by delaying cooling or blocking the flow of quench gas, the resulting fiber essentially contains a plurality of zones, defined by different characteristics including differences in melt flow rate, molecular weight, melting point, birefringence, orientation and crystallinity. In particular, as disclosed in these patents, a fiber produced therein can include an inner zone identified by a substantial lack of oxidative polymeric degradation, an outer zone of a high concentration of oxidative chain scission degraded polymeric material, and an intermediate zone identified by an inside-to-outside increase in the amount of oxidative chain scission polymeric degradation. In other words, the quenching of the hot extrudate in an oxygen containing atmosphere can be controlled so as to obtain a fiber having a decreasing weight average molecular weight towards the surface of the fiber, and an increasing melt flow rate towards the surface of the fiber.

Further, U.S. patent applications Ser. Nos. 08/080,849, 08/378,267, 08/378,271 and 08/378,667 to Takeuchi et al., and European Patent Application No. 0 630 996 to Hercules Incorporated, which are incorporated by reference as if set forth in their entireties herein, are directed to obtaining fibers having a skin-core morphology, including obtaining fibers having a skin-core morphology in a short spin process. In these applications, a sufficient environment is provided to the polymeric material in the vicinity of its extrusion from a spinnerette to enable the obtaining of a skin-core structure. For example, because this environment is not achievable in a short spin process solely by using a controlled quench, such as a delayed quench utilizable in the long spin process, the environment for obtaining a skin-core fiber is obtained by using apparatus and procedures which promote at least partial surface degradation of the molten filaments when extruded through the spinnerette. In particular, various elements can be associated with the spinnerette, such as to heat the spinnerette or a plate associated with the spinnerette, so as to provide a sufficient temperature environment, at least at the surface of the extruded polymeric material, to achieve a skin-core fiber structure.

Nakajima et al. (in "Advanced Fiber Spinning Technology," Woodhead Publishing Ltd., 1994, pages 49–53), which is incorporated by reference as if set forth in its entirety herein, examines the effect of spin height on crystal formation in high-speed spinning of nylon fibers.

There is still a need for nonwoven fabrics with improved properties such as strength, softness and vapor permeability, and there is still a need for fibers and nonwovens with improved strength, durability and efficiency of production.

There is also a need for a melt-spun fiber or filament that exhibits high strength upon bonding of webs comprising the fiber or filament. Similarly, there is a need for melt-spun fiber or filament that exhibits high resistance to thermal shrinkage. There is also a need for a bonded nonwoven fabric, for example, a thermal bonded nonwoven fabric, that exhibits high cross-directional strength.

There is also a need for a process for the production of melt-spun fiber or filament. preferably one which permits a high spin speed while preserving spin continuity. Such a process should preferably be amenable to the production of, for example, mono- or bi-component fibers, mono- or multi-constituent fibers, skin-core fibers and the like.

There is also a need for apparatus for the production of melt-spun fiber or filament, preferably, one which can attain high spin speed while maintaining spin continuity. Such an apparatus may be used to produce, for example, mono- or multi-component fiber, including bi-component fiber, mono- or multi-constituent fibers, fibers with or without a skin-core structure, and the like.

SUMMARY OF THE INVENTION

The present invention provides for processes and apparatus for the production of melt-spun filament, preferably polyolefin filament, even more preferably filament comprising polypropylene, and to the resulting filaments and articles.

Thus, processes and apparatus according to the present invention may be used to produce filament with advantageous properties. In one aspect, the present invention provides spinning processes and apparatus that utilize a shortened spin height compared to traditional long spin systems. In another aspect, the present invention provides spinning processes and apparatus that utilize guidance elements for making the flow of quench gas across the filaments more uniform, thus permitting reduced quench gas velocity and better spin continuity. In another aspect, the present invention provides processes and apparatus that utilize an exhaust extension to increase quench efficiency by increasing downdraft.

In both process and apparatus aspects, the shortened spin height, guidance elements and exhaust extension may be employed independently or in combination. The guidance elements and exhaust extension may, therefore, also be used, alone or in combination, in other spinning systems including, for example, traditional long and short spin systems.

Thus, the present invention provides a process for spinning polyolefin filament comprising extruding a polyolefin-containing composition through at least one spinnerette to form at least one molten extrudate, quenching the at least one molten extrudate to form at least one filament, and passing the at least one filament over a take-up roll, at a spin height of about 1 to 4 meters, at a spin speed of at least about 500 m/min.

The present invention also provides a process for spinning polyolefin filament comprising extruding a polyolefin-containing composition through at least one spinnerette to form at least one molten extrudate, quenching the at least one molten extrudate to form at least one filament, and passing the at least one filament over a take-up roll, at a spin height of less than about 3 meters, at a spinning speed of at least about 500 m/min.

Preferably the spinning speed is about 1,000 to 2,200 m/min, even more preferably about 1,600 m/min.

Processes and apparatus of the present invention preferably employ a spin height, the vertical distance from face of a spinnerette to the center of the take-up roll greater than about 1 meter. More preferably, the spin height is about 1 to 4 meters, even more preferably about 1.5 to 3 meters, yet more preferably about 1.8 to 2.5 meters, and most preferably about 2 meters.

The quenching preferably includes directing a quench gas toward a first side of the at least one spinnerette. The quench gas preferably comprises an oxidative gas capable of oxidizing the at least one molten extrudate, so as to effect oxidative chain scission degradation of at least the surface of the at least one molten extrudate to form at least one filament with a skin-core structure. Even more preferably, the at least one spinnerette comprises a first side and an oppositely disposed second side, and the quenching includes directing a quench gas toward the first side. Preferably, there is a shroud associated with at least the first side of the at least one spinnerette.

Further, the quench gas flow speed is preferably about 30 to 215 m/min at the first side of the at least one spinnerette, more preferably about 60 to 155 m/min, and even more preferably about 90 to 125 m/min. The quench gas flow volume measured at the entrance of the quench chamber is preferably about 35 to 100 cmm (cubic meters per minute), more preferably, about 55 to 90 cmm, even more preferably, about 60 to 80 cmm.

Yet further, the quench gas preferably comprises an oxidative gas capable of oxidizing the at least one molten extrudate so as to effect oxidative chain scission degradation of at least the surface of the at least one molten extrudate. More preferably, there is a shroud associated with at least the first side of the at least one spinnerette.

The present invention also provides a process and apparatus for spinning polyolefin filament comprising extruding a polyolefin-containing composition through at least one spinnerette to form at least one molten extrudate, and quenching the at least one molten extrudate to form at least one filament, in which at least two guidance elements are associated with the at least one spinnerette. Preferably, there is also a quenching unit to direct a flow of quench gas toward the first side of the at least one spinnerette.

The at least two guidance elements are preferably associated with the at least one spinnerette, even more preferably, the at least two guidance elements comprise guidance elements associated with, or positioned on, opposing lateral sides of the at least one spinnerette. Even more preferably, the at least one spinnerette comprises a plurality of spinnerettes, and the at least two guidance elements include a guidance element associated with each of outermost sides of the plurality of spinnerettes and/or guidance elements associated with opposing lateral sides of the plurality of spinnerettes. Even more preferably, the plurality of spinnerettes comprises two spinnerettes.

The at least two guide elements preferably comprise leading ends (comprising leading edges) and trailing ends (comprising trailing edges), the leading ends preferably being substantially planar. The trailing ends preferably comprise deflector portions. The deflector portions are preferably substantially planar and are preferably directed inward at deflector angles of about 10° to 60°. More preferred deflector angles are about 20° to 50°, more preferably about 25° to 40°, even more preferably about 30° to 35°, and most preferably about 30°. The leading ends of the guidance elements are preferably substantially parallel to the direction of the flow of the quench gas.

The present invention also provides a process for spinning polyolefin filament comprising extruding a polyolefin-containing composition through at least one spinnerette to form at least one molten extrudate, and quenching the at least one molten extrudate to form at least one filament, in which a downdraft extension is preferably associated with the at least one spinnerette and/or with an exhaust unit.

The present invention also provides an apparatus comprising at least one spinnerette with a first side and an oppositely disposed second side; a quenching unit to direct a flow of quench gas toward the first side of the at least one spinnerette; and a downdraft extension associated with the second side of the at least one spinnerette.

Further, the downdraft extension is preferably associated with the second side of the at least one spinnerette and/or with an exhaust unit for removing at least a portion of the quench gas. The downdraft extension is preferably substantially planar. Even more preferably, the downdraft extension is inwardly directed at an exhaust extension angle of about 0° to 80°. Even more preferably, the downdraft extension angle is about 10° to 70°, more preferably about 30° to 50°, and most preferably about 45°.

As discussed above, the guidance elements and/or downdraft extension are not limited to systems utilizing a shortened spin height, but can be used with other spin systems for the spinning of filaments.

Preferably, the present invention also includes applying a spin finish to the extrudate or filament, the applying preferably being between the quenching and the passing over the take-up roll. The spin finish preferably comprises a hydrophobic finish or a hydrophilic finish, and may also include an antistatic composition.

The present invention also provides an apparatus for directing the flow of quench gas in a melt spinning system comprising a guidance wing.

The present invention also provides an apparatus for increasing the downdraft in a melt spinning system comprising a downdraft extension.

The present invention also provides for the filament and fiber prepared according to the present invention described above, and products prepared from the fiber or filament. Thus, the present invention additionally provides for processed fiber or filament, such as crimped staple fiber. The invention also provides for fabrics comprising the fiber or filament, preferably nonwoven fabric, more preferably, thermal bonded nonwoven fabric. The invention also provides for articles comprising the fiber or filament, preferably articles comprising a nonwoven fabric, preferably thermally bonded, comprising the fiber or filament. The fibers and filaments, as well as fabrics and articles comprising the fabrics and filaments, preferably comprise finishes.

BRIEF DESCRIPTION OF THE DRAWINGS

As an aid to more easily understanding the present invention, figures, which include non-limiting illustrative embodiments of the invention, have been annexed hereto. The figures are briefly described below.

FIG. 6*a* corresponds to inventive fabric prepared according to Example I. FIG. 6*b* corresponds to fabric prepared according to the Control example.

DETAILED DESCRIPTION OF THE INVENTION

The present invention is directed to apparatus for producing melt-spun fiber or filament, the process used in producing the fiber, the fiber so produced, and articles incorporating the fiber so produced.

Various forms of fibers within the scope of the present invention include filaments and staple fibers. These terms are used in their ordinary commercial meanings. Typically, "filament" is used herein to refer to the continuous fiber on the spinning machine. As a matter of convenience, however, the terms fiber and filament are sometimes used interchangeably herein. "Staple fiber" is used to refer to cut fibers or filaments. Staple fiber is used in a multitude of products, such as personal hygiene, medical, industrial and automotive products and commonly ranges in length from about 5 mm to about 16 cm. Preferably, for instance, staple fibers for nonwoven fabrics useful in diapers have lengths about 2.5 cm to 7.6 cm, more preferably about 3.2 cm to 5 cm. Thicknesses of fiber or filament are measured in denier per filament (dpf), which is the weight in grams of 9,000 m (9 km) of filament. As a matter of convenience, "fiber" is herein also used to describe filament or staple fiber.

Unless otherwise stated, spin speeds are measured as take-up spin speeds, i.e., at the take-up roll as described below.

Figure 3:
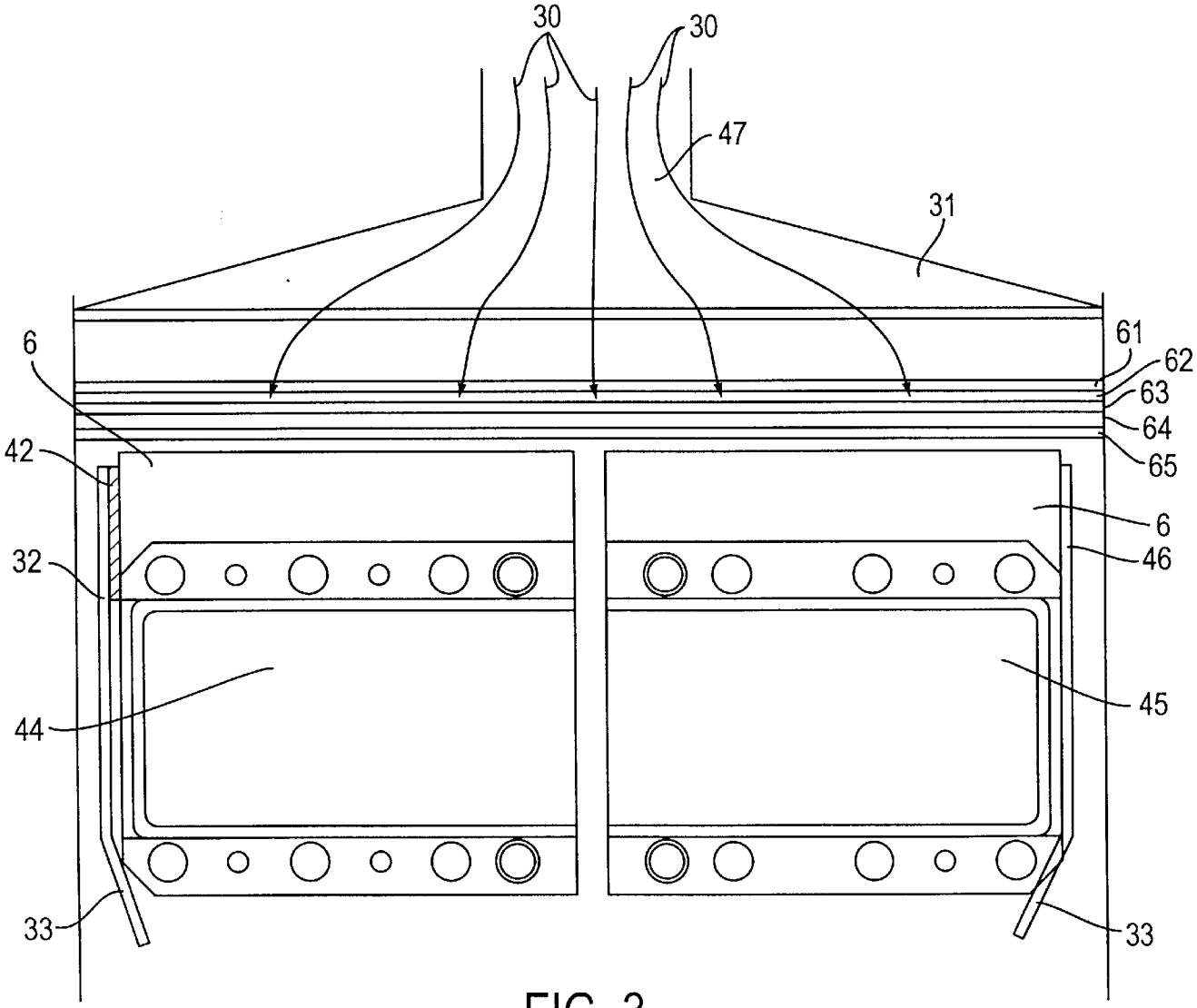
FIG. 3 is a bottom plan view of a spin position of two spinnerettes according to an embodiment of the present invention.

Unless otherwise stated, spin heights are measured as the vertical distance from the face of a spinnerette, i.e., the lowest portion of the spinnerette from which the filaments are extruded, to the center of the take-up roll. The take-up roll is the first roll that operates at line speed. Thus, if the spinning speed is 1,000 m/min, then a point fixed on the surface of the take-up roll has a speed of 1000 m/min.

Where the direction of flow of quench gas is used as a reference, it refers to the direction of the quench gas before it enters the blow box, as will be discussed below with reference to FIG. 3.

One factor affecting the strength of a nonwoven fabric produced from melt-spun fibers is the structure, or lack thereof, in the fiber. Fibers of synthetic polymers, such as polyolefins, including polypropylenes, can typically exist in several structurally distinct phases. Three of these phases—the crystalline, smectic, and amorphous phases—are commonly observed in polyolefin-containing fibers, such as fibers containing polypropylene. In the amorphous phase, the molecules are tangled and twisted in a random fashion and have no discernible overall structure. In the crystalline phase, the molecules take on a rather well-defined oriented structure. Polymer molecules in the crystalline phase are much more structured and less random than in the amorphous phase. The smectic phase is an intermediate phase less ordered than crystalline, but more ordered than amorphous. Melt-spun fibers generally contain all three phases simultaneously. The relative amounts of the phases present in the solid polymer depend on several factors, including the conditions under which the melt is cooled. A variety of methods which may be determined by those of ordinary skill in the art, including those described and utilized herein, may be used to determine the proportion of each phase present in a given sample.

It appears that the smectic content of fibers plays an important role in the strength of thermal bonded fabric and articles made therefrom. For example, it has been observed that increasing the smectic content of the fiber results in nonwoven bonded fabrics of higher cross-directional strength as compared to fabrics produced under the same, or substantially the same, conditions but from fibers with lower smectic content. Increasing the smectic content of synthetic fibers may be done at the expense of either the crystalline or amorphous content, or both. It has been found that the smectic content of melt-spun fiber comprising a polyolefin, such as polypropylene, can be increased through a long spin process that utilizes a decreased spin height compared to traditional long spin processes. Melt-spun polyolefin filaments manufactured in traditional long spin or short spin systems typically have about 20–30% smectic content. When measured with the wide-angle X-ray technique (WAX) described below, polyolefin filaments, especially polypropylene filaments, made in the inventive system preferably have smectic contents at least about 32%, and even more preferably, at least about 35%. Without limiting the invention, the smectic content is generally below about 40%.

Notable aspects of the present invention relate to the shortened spin height relative to traditional long-spin processes, and to aspects of the quench, such as quench conditions, including configuration of the quench box.

Figure 1:
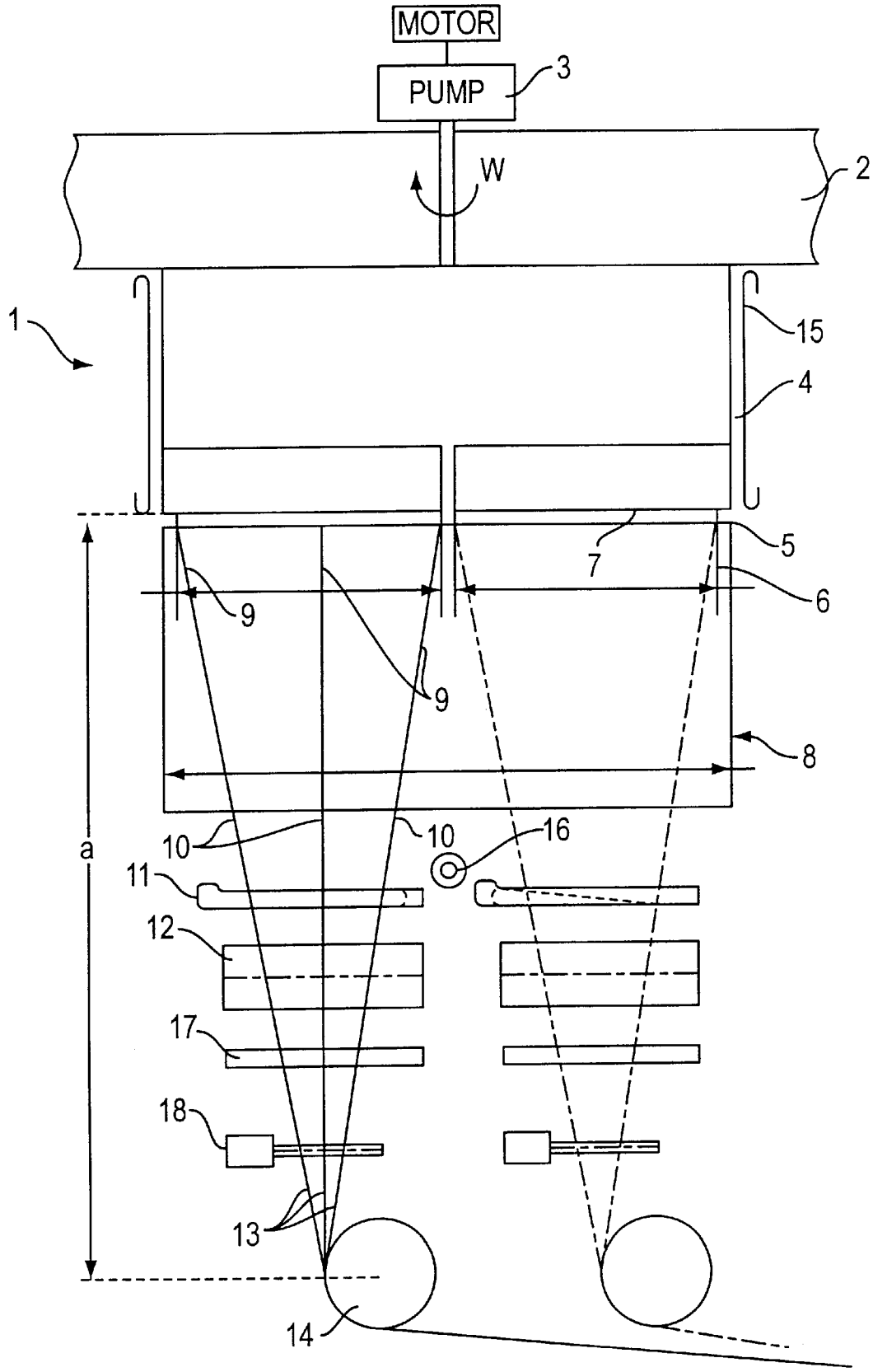
FIG. 1 is a schematic drawing of an apparatus for manufacture of fibers according to the present invention. Shown are the extrusion system, the quenching system, and the spin finish and take-up systems.

FIG. 1 is a schematic drawing of an illustrative embodiment of the invention, generally labeled as 1. The illustrative embodiment is designed to produce skin-core fibers, however, while skin-core fibers are preferred, the invention is not limited to skin-core fiber, and includes processes and apparatus for producing various mono- and multi-component fiber, and/or mono- and multi-constituent fibers, with or without a skin-core structure. At the top of apparatus 1 is a heated beam 2 for maintaining the melt temperature of the polymer or polymer blend. Below the heated beam 2 is the spin head 4, which contains the spin pack including spinnerettes 7. Spin head 4 is heated by electric band heater 15. While two spinnerettes are shown in FIG. 1, the number of spinnerettes used is largely a commercial decision and may be made by those of ordinary skill in the art.

A spin pump 3 pumps the melt from the heated beam 2 to the spin head 4. The melt is then extruded through the spinnerettes 7 to form molten filaments 9. A quench box 8 is positioned with its top portion 5 near the level of the spinnerettes 7. Inside the quench box is a shroud 6 which is attached to the quench side of spinnerette 7. Shroud 6 blocks the quench air flow across filaments 9 near the top of quench box 8, thereby delaying the quench to obtain oxidative chain scission degradation of the surface of the molten filaments. Aspirator 16 diverts waste bundles to a waste buggy. The quenched solid filaments 10 are then led to guide bars 11 and then to kiss rolls 12 where a finish is applied. Each guide bar 17 cooperates with corresponding guide bar 11 to improve contact of filaments 10 with kiss roll 12. Slub catcher 18 removes slubs (aggregates of polymer not in filament form) which may have formed. The filaments are then led to take-up roll 14. After leaving take-up roll 14, which can be powered or free-wheeling, the filament can be further processed in various processing procedures, including, for example, collecting, drawing, crimping, and/or cutting.

Although many characteristics of the inventive system are shared with long spin systems, the inventive process uses a spin height, a in FIG. 1, which is similar to spin heights used in short spin systems. The spin height, the vertical distance from the spinnerette face 7 to the center of the take-up roll 14, is preferably between about 1 to 4 meters, more preferably between about 1.5 to 3 meters, even more preferably between about 1.8 to 2.5 meters, and most preferably about 2 meters.

Spin height affects filament tension both near the spinnerette and near the take-up roll. As molten filament is drawn downward, both gravity and the take-up roll exert downward pull on the filament, as the filaments accelerate downward. The spin speed, which is measured at the take-up roll, and the final filament diameter at the take-up roll are about the same for the inventive short, and common long, spin heights. While not wishing to be bound by any theory, it is believed that the tension in filament 9 near spinnerette face 7 is greater where the spin height is shorter because the filament must undergo greater acceleration to reach the same final speed in a shorter distance. It is also believed that the tension in the filament near location 13, which is near take-up roll 14, is less with a shorter spin height because there is less air drag due to less downdraft along the filament axis causing less skin friction or drag on the filament over the shorter distance. Thus, the shorter spin height for the same quench conditions should result in greater tension on the molten part of the filament, and less tension on the quenched part of the filament, i.e., less cold draw to the first take-up roll.

It also appears that this decrease in cold draw contributes to the observation that fibers produced through this new spinning system also exhibit improved resistance to thermal shrinkage over that usually observed in fibers produced from a traditional long spin process. TMA (Thermal Mechanical Analysis) shrinkage of fibers prepared according to the present disclosure, when measured as described below, is preferably less than about 3.3%, more preferably less than about 3%, and even more preferably less than about 2.8% when measured at 120° C. TMA shrinkage is preferably less than about 4.8%, more preferably less than about 4%, and even more preferably less than about 3% when measured at 150° C.

The number and type of spinnerettes or capillaries used in a particular spin system is typically dictated by commercial considerations, and is determined by those of ordinary skill in the art for each application. Typically, each spinnerette used in a long spin system includes about 50 to 4,000 capillaries, more preferably 700 to 3,500 capillaries, even more preferably about 2,500 to 3,300 capillaries. Where bi-component or other multi-component filament is produced, the number of capillaries refers to the number of filaments, and not the number of holes in the spinnerette for polymer extrusion. Without limiting the invention, commercial long spin systems commonly include 2 spinnerettes per position, i.e., two spinnerettes per quench box, about 4–30 positions per line more preferably 12–24 positions per line, and about 2–5 lines, each spinnerette typically having about 50 to 4,000 capillaries, preferably about 2,500 to 3,300 capillaries. The spinnerettes may be of any type suitable for making filaments, including spinnerettes for making mono-component, bi-component or other multi-component filament, further including side-by-side or sheath core filament.

Preferably, filaments produced in the inventive system have a skin-core structure, but the inventive system may also produce filaments without a skin-core structure.

Moreover, the capillaries may be of any type suitable for making filaments. For example, the capillaries can have various cross-sectional configurations to produce filaments with, for example, circular, diamond, delta, concave-delta, trilobal, oval, "X"-shaped or "H"-shaped cross-sections. Preferably, the capillaries will produce filaments with circular or concave delta cross-sections. Thus, for example, filaments such as circular cross-section bicomponent skin-core fibers, which includes a sheath-core structure having a skin-core structure in the sheath, may be produced in the inventive system. Those of ordinary skill in the art may select the capillaries that produce the desired cross-section. The inventive spin system is not limited to any particular number or type of spinnerettes or capillaries.

As the extruded filaments accelerate downward toward the take-up roll, they induce a downdraft in the surrounding air. The downdraft is along the longitudinal spin axis and in the same direction as the filaments' velocity, which is also approximately perpendicular to the velocity of the quench gas as it flows into the quench box. As discussed above, increased downdraft contributes to increased spin tension. However, increased downdraft also assists in quenching the filaments. Because of the shorter spin height of the inventive system compared to a traditional long spin system, the inventive system imparts less acceleration to the surrounding air, resulting in less downdraft. Unless otherwise indicated, downdrafts reported herein are measured above the spin finish applicator, which is where the maximum downdraft is normally expected. Thus at a spinning speed of about 1200 m/min, downdraft in the compact system without downdraft extension or guidance wings is typically about 425 m/min. At about the same spin speed, downdraft in traditional polypropylene long-spin systems is typically greater than or about 670 m/min. As a result of the decreased downdraft, a spinning system with a shortened spin height generally requires a somewhat greater quench gas flow. A greater quench gas flow, however, may lead to greater filament breakage at higher spin speeds, especially those filaments at the outer sides of the quench box. At about the same spin speed, a spinning system with shortened spin height, guidance wings and downdraft extension can exhibit a downdraft similar to traditional long spin systems, permitting use of a lower quench gas flow.

As discussed above, after being extruded from the spinnerettes, the molten filaments are quenched, typically with a gas blown in a direction substantially perpendicular to the filamentary axes, i.e., approximately normal to the spin axis. The speed and temperature of the quench gas should be sufficient to effect quenching of the filaments prior to their reaching the take-up roll. The quench may be accelerated by, for example, either increasing the gas speed, decreasing the gas temperature or a combination of these. Moreover, in instances where a shroud is used, such as to obtain a skin-core structure, the quench can be accelerated by having a shorter shroud height. The distance over which the filaments are quenched depends on these parameters as well as, for example, fiber thickness, fiber temperature, polymer type and additives used.

Quench gas of any composition may be used within the scope of the present invention and may be determined according to particular needs by those of ordinary skill in the art. For example, the quench gas may comprise air, including gasses such as air, air enriched with oxygen and air enriched with nitrogen. Another suitable quench gas, for example, is nitrogen In a preferred embodiment, the quench gas comprises air and preferably consists essentially of air.

To assist the quenching in both the compact long spin of the present invention as well as in other spinning systems, including long spin and short spin systems, there are provided elements that can be utilized alone or in combination. Thus, in one aspect, a quenching system according to the present invention is provided guidance elements. These guidance elements, or "guidance wings," are structured and arranged to render the flow of quench gas past the filaments more uniform, and quench more efficiently, than without the guidance elements.

Figure 2:
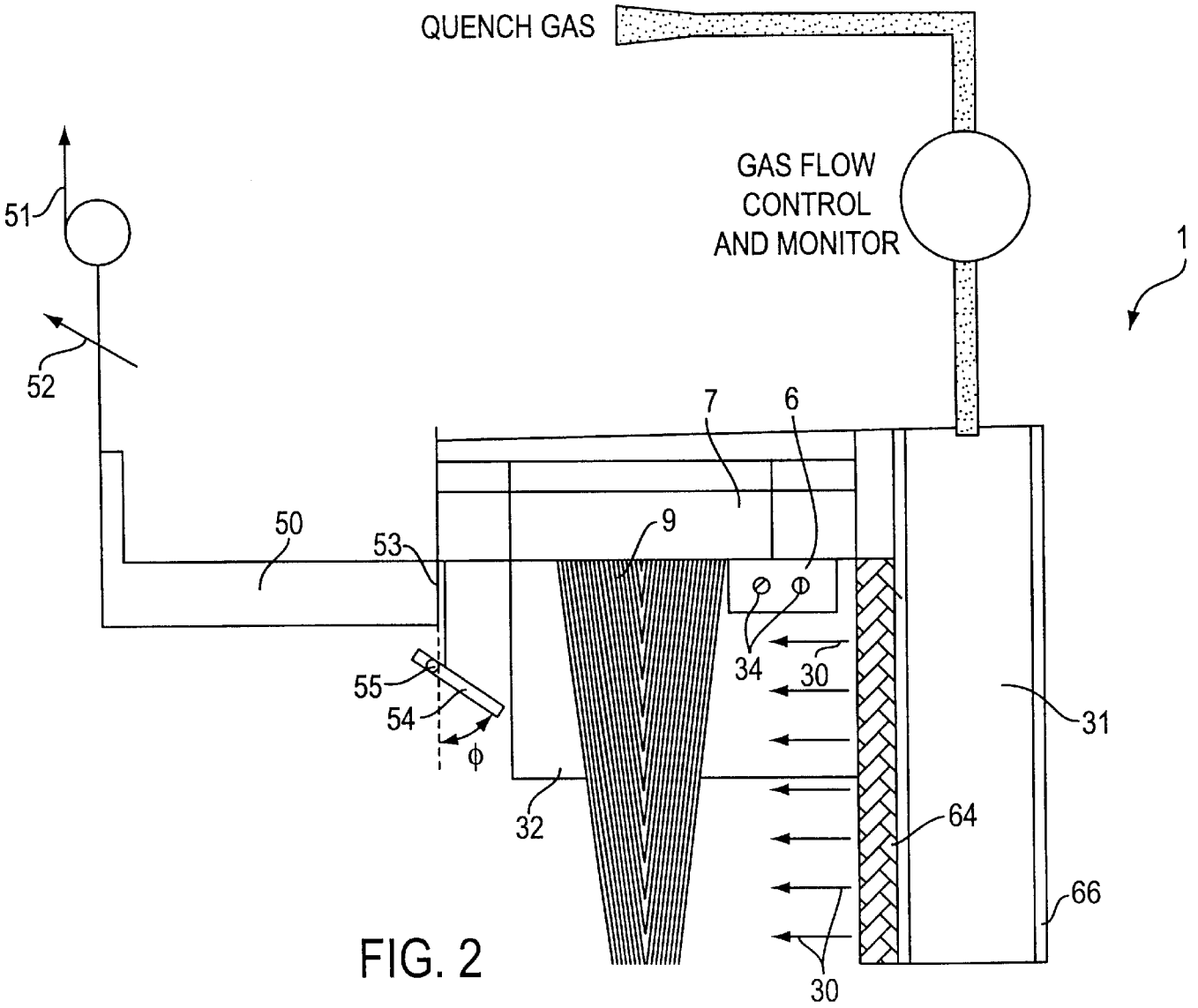
FIG. 2 is a schematic drawing of an apparatus for manufacture of fibers, illustrating details of a quenching system according to an embodiment of the present invention.

A cross-sectional side view of one embodiment of the present invention is presented in FIG. 2, which is not drawn to scale. Quench gas 30 is blown from blow box 31 toward spinnerettes 7 in a direction approximately normal to the spin axis. Where fiber with a skin-core structure is to be manufactured, the quench may be delayed, for example, with shroud 6.

Figure 7:
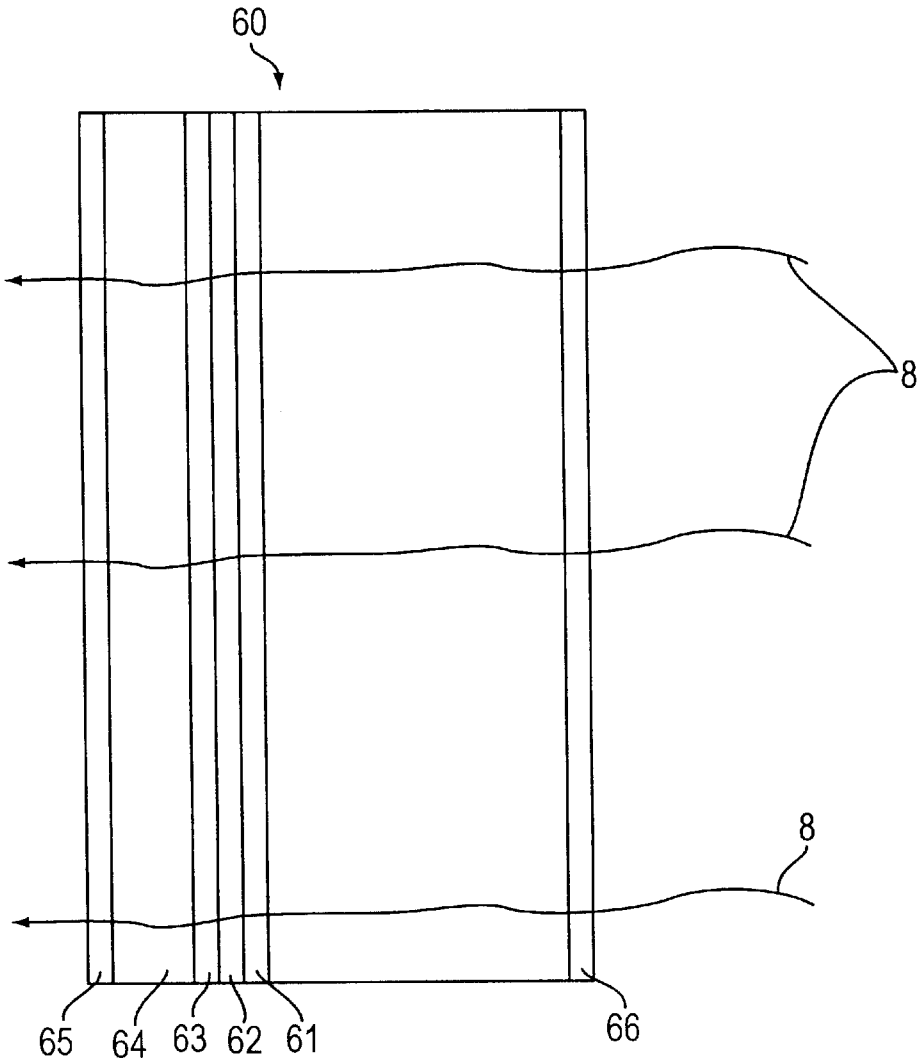
FIG. 7 is a schematic of a side view cross section of a quench gas diffuser assembly which may be used in accordance with the present invention.

An expanded schematic view of blow box 31 is presented in FIG. 7. Before quench gas 30 enters quench box 8, the quench gas passes through the quench gas diffuser assembly, generally shown as 60. Quench gas diffuser assembly 60 serves to reduce the turbulence of the flow of quench gas 30 into quench box 8, and induce a more uniform laminar flow. Any means of accomplishing this result, in addition to the embodiment herein described, may be constructed and used by those of ordinary skill in the art.

Quench gas diffuser assembly 60 typically comprises a first perforated plate 66, front perforated plate 61, center perforated plate 62 and rear perforated plate 63. Behind rear plate 63 is foam insert 64, which is backed by grid 65.

According to one non-limiting embodiment of the invention, front plate 61 comprises a substantially rectangular plate about 80 cm high and 90 cm wide. The upper approximately 36 cm has a plurality of substantially circular openings approximately 6.35 mm in diameter arranged in an array approximately 25×78. The lower approximately 44 cm of the front plate comprises an array of approximately 1.59 mm diameter holes on about 3.145 mm staggered centers to produce a 22.5% open area. Center plate 62 and rear plate 63 comprise arrays of approximately 1. 59 mm diameter holes on about 2.38 mm staggered centers to produce 41% open areas in each plate. Plates 61–63 and 66 may be made of any material able to withstand blow box operating conditions.

For example, the plates may be made of metal, plastic or a composite material. Preferably, the plates are made of 22 gage stainless steel. Moreover, according to one embodiment, foam insert 64 can comprise a reticulated foam insert, for example, Scott type S1F, 30PPI, with a self-extinguishing additive. Grid 65 retains foam insert 64 in place.

Guidance wings 32, shown in FIG. 2, serve to guide quench gas 30 past filaments 9. The guidance wings may be installed in any manner which fixes it in position, as may be determined by those of ordinary skill in the art. For example, a guidance wing may be attached to a spinnerette, a side of the quench box, and/or, if present, a shroud. Further, the wing may be attached by any means, such as with bolts or welds, and/or through unitary or integral construction with another component of the apparatus. The guidance wings may be installed, for example, with two bolts 34 through each wing and into the shroud.

The lateral sides of a spinnerette are the sides substantially parallel to the flow of quench gas 30 regardless of the shape of the spinnerette. The guidance wings are preferably positioned at or near one or more lateral sides of the spinnerette(s). Even more preferably, at least two guidance wings are positioned on opposite sides of a spinning position, that is, near the outermost lateral sides of the set of spinnerettes, as shown in FIG. 3. For example, a spinning position having one spinnerette therein would have two guidance wings, positioned on opposite sides of the spinnerette. A spinning position having two spinnerettes therein advantageously also comprises two wings, which are located on opposite sides of the spinning position. Such a positioning of the wings is illustrated in FIG. 3 for a spinning position of two spinnerettes.

Generally, each guidance wing is provided with an elongated portion which is preferably substantially planar. Further, each wing is preferably provided with a deflector portion on the end farther from the blow box. When present, the deflector may be of any configuration, and is preferably substantially planar. In the embodiment illustrated in FIG. 3, wing 46 is provided with an inwardly directed deflector 33. As used herein, by describing a part as "inwardly directed" is meant that the part is angled toward the spinnerette or spinnerettes. Wing 46 may be attached directly to shroud 6.

The distance from a lateral side of a spinnerette to an associated guidance element may be determined by those of ordinary skill in the art. The guidance element may be adjacent to the lateral side, as when the wing is directly attached to the spinnerette or directly attached to a shroud which extends approximately as far as the associated lateral side of the spinnerette. The spacing may be increased by several methods, such as by placing a spacer between the guidance element and the shroud or spinnerette to which it is attached, or by installing the guidance wing on another component of the spinning system, such as a side of the quench box.

Preferably, the elongated portion of a guidance wing is adjacent the associated lateral side of the spinnerette, but it may optionally be spaced up to about 3 cm, or farther, from the spinnerette. Referring to FIG. 3, for example, wing 32 is optionally provided with spacer 42 to increase the separation between wing 32 and left spinnerette 44. Rather than requiring fixed placement of a guidance wing, a guidance wing can be translationally adjustably mounted, as on a threaded rod, to facilitate, for example, lateral positioning of the wing.

The guidance wings are preferably oriented with the elongated portion substantially parallel to the flow of quench gas and also substantially vertical. However, one or more guidance wings can also be hingedly mounted to permit angular positioning of the wing away from the substantially vertical and/or parallel orientations relative to a spinnerette.

The guidance wings may be oriented in any direction which advantageously guides the quench gas. Where the elongated portions of the guidance wings are substantially planar, for example, as shown in FIG. 3, it is preferable to orient the wings so that the elongated portions are substantially parallel to the direction of flow of quench gas 30 at entrance 47 of blow box 31. That is, a guidance element is preferably oriented substantially parallel to a lateral side of a spinnerette.

Figure 4D:
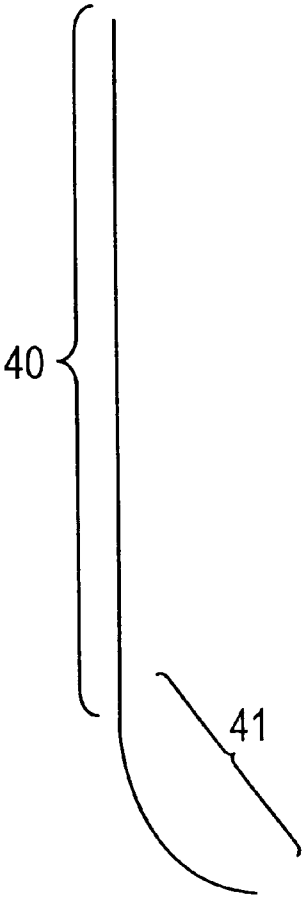
FIGS. 4*a, b, c* and *d* show top plan views of illustrative embodiments of guidance elements according to the present invention.
Figure 4C:
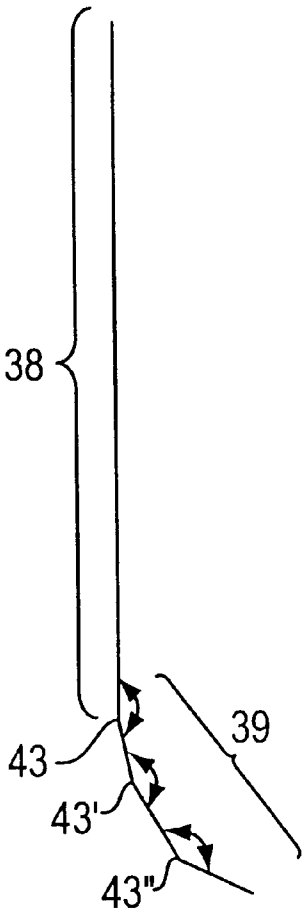
Figure 4B:
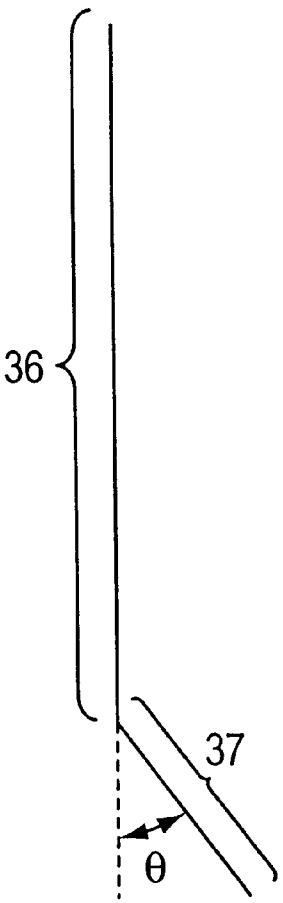
Figure 4A:
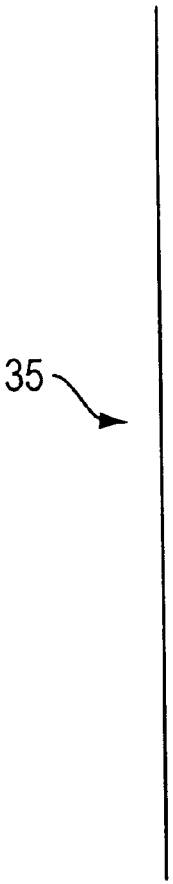

Top views of several embodiments of guidance wings according to the present invention are presented in FIGS. 4*a*, 4*b*, 4*c*, and 4*c*. In general, each guidance wing in FIG. 4 is provided with a substantially planar elongated guide portion, and optionally provided with a deflector. The leading end of the wing, the end closer to the blow box, comprises the guide portion, and the trailing end of the wing, the end closer to the exhaust, comprises the deflector portion (when the deflector portion is present).

FIG. 4*a* illustrates perhaps the simplest type of guidance wing, which comprises guide portion 35 without a distinct deflector portion. FIG. 4*b* illustrates a guidance wing with substantially planar guide portion 36 and substantially planar deflector portion 37. In this embodiment, deflection angle θ is measured as the angular deviation of deflector portion 37 from the plane containing guide portion 36. FIG. 4*c* illustrates a guidance wing with deflector portion 39 comprising a plurality of bends 43', 43", and 43'". FIG. 4*d* illustrates a guidance wing with deflector portion 41 comprising a curve. These embodiments are illustrative and not limitative of the present invention. Other embodiments, including those with guide portions that are not substantially planar, or with deflector portions comprising more complicated shapes, or with deflector portions on the leading end of the wing, are also included within the scope of the invention.

Where a guidance wing of the type in FIG. 4*b* is employed, deflection angle θ is preferably about 10° to 60° even more preferably about 20° to 50°, even more preferably, 25° to 40°, even more preferably about 30° to 35° and most preferably about 30°. Of course, a deflection angle of 0° is also within the scope of the present invention, and corresponds to the guidance wing of FIG. 4*a*.

Figure 5:
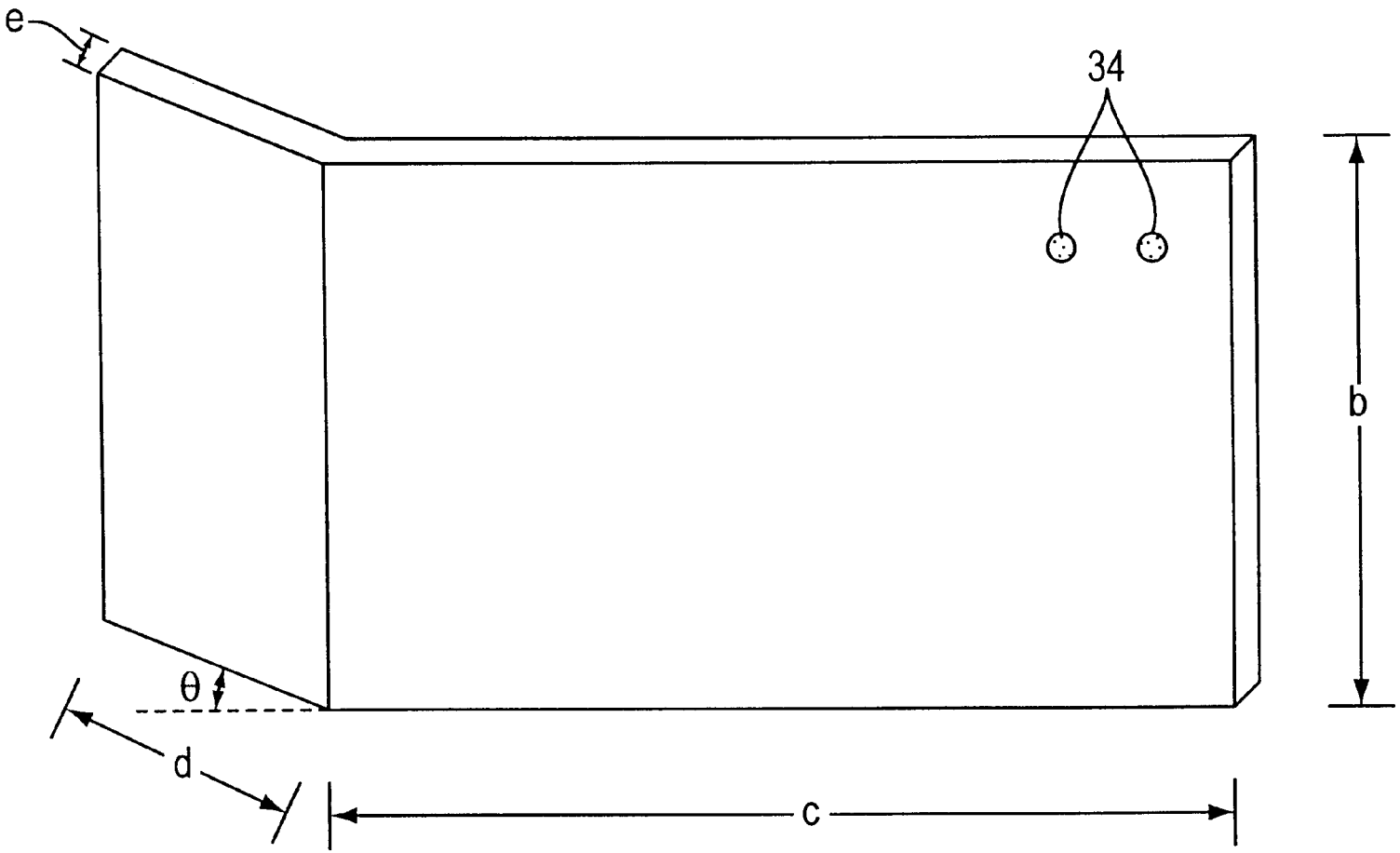
FIG. 5 presents details of the guidance element of FIG. 4*b*.

The exact dimensions of the guidance wings may be determined by one of ordinary skill in the art. Dimensions of a guidance wing of the type of FIG. 4*b* are referenced in FIG. 5, which presents a side view of the wing. Without limiting the invention, preferred dimensions of the guidance wing as illustrated in FIG. 4*b*, when using a shroud about 32 mm high for development of a skin-core structure, are as follows: wing height b is about 30 to 200 mm, preferably about 127 mm, of which about 32 mm of the top portion of the wing overlaps the shroud; guide portion c of the wing is about 100 to 300 mm, preferably about 159 mm long; deflector portion d of the wing is about 10 to 100 mm long, preferably about 59 mm long; and thickness e is about 1 to 10 mm, preferably about 7 mm.

The exact composition of the guidance wings is not critical, and can be made of any material able to withstand conditions near the spinnerette. The wings may be made of, for example, metals or alloys, plastics, composites, etc. In a preferred embodiment, the wings are made of stainless steel.

Without limiting the invention, it is believed that the wings permit a more uniform quench across the extruded filaments by reducing the amount of quench air that escapes from the sides of the spinnerettes. This should permit more efficient quenching at the outer corners of the spinnerettes, thereby permitting a lower velocity for the quench gas and enabling greater spin continuity.

In another aspect, a quenching system according to the present invention is provided a downdraft extension. The downdraft extension is constructed and arranged to increase the downdraft, and thereby increase quench efficiency and permit use of lower quench gas speed. The exhaust extension may have any shape, and may be, for example, rectangular, square, trapezoidal, oval or round. A preferred exhaust extension is rectangular. The lateral sides of a preferred rectangular exhaust extension are preferably about 50 to 200 mm, and even more preferably about 102 mm long. The horizontal sides are preferably about as wide as the quench box.

The surface of the downdraft extension may be of any shape. For example, the surface may be substantially planar, may comprise a series of bends, or may be curved, as a section of a sphere or cylinder. In a preferred embodiment, the surface of the downdraft extension is substantially planar.

The downdraft extension may be placed at various orientations, and may be, for example, angled inward (toward the spinnerette(s)), angled outward (away from the spinnerette(s)), or vertical. Where the surface is substantially planar, the downdraft extension angle $\phi$ is measured from the vertical. Thus, extension angle $\phi$ may be positive (angled inward), negative (angled outward) or zero. A positive extension angle $\phi$ is shown in FIG. 2. Preferably, the downdraft extension is angled inwardly at an angle of about 0° to 80°, more preferably about 10° to 70°, even more preferably about 30° to 50°, and most preferably about 45°.

The exhaust extension may be made of any material provided that the extension is sufficiently rigid to effectively alter gas flow. For example, the extension may be made of metal or alloy, glass, plastic, or a composite material. In order to permit easier inspection of the equipment and process, the extension is advantageously made of a transparent material, preferably plexiglass.

Further, the exhaust extension may be positioned in any location that allows it to increase the downdraft in the spinning system. Preferably, the downdraft extension is associated with the exhaust unit or system which removes at least a portion of the quench gas after the quench gas has passed a spinnerette. Even more preferably, the downdraft extension is at or adjacent to the exhaust unit or inlet. Even more preferably, the downdraft extension is attached to the exhaust inlet, preferably attached to the lower portion of the exhaust inlet.

As seen in FIG. 2, the exhaust system comprises exhaust pipe 50 located on the opposite of the quench box from blow box 31. Exhaust fan 51 enables exhaust pipe 50 to intake gas through exhaust inlet 53 and remove it from the area of the spinning apparatus. Exhaust damper 52 enable adjustment of the exhaust pressure in exhaust pipe 50. Below exhaust inlet 53 is exhaust extension 54, which is secured to exhaust inlet 53 at connection 55. Exhaust extension 54 is preferably substantially planar and preferably inwardly directed—angled toward the spinnerette or spinnerettes—and forms downdraft extension angle $\phi$ from the vertical. Preferably, connection 55 comprises an adjustable locking hinge, preferably two such hinges, to facilitate adjustment of the downdraft extension angle.

With the downdraft extension in place, quench gas is retained for a longer period of time in the area of the spinnerette, permitting more gas to be caught up in the downdraft than without the extension. By means of an exhaust extension, therefore, the downdraft may be increased, resulting in increased quench efficiency, without necessarily increasing quench gas speed.

The dimensions of the quench box itself may be determined by those of ordinary skill in the art, and is affected by such factors as the number of spinnerettes per position, the size and type of spinnerette, spin speed, etc. Without limiting the invention, it has been found, for example, that when using a spin position of two Mark IV spinnerettes (Wetzel, Sissein. Switzerland) with their long axes along a single line then the quench box is preferably about 889 mm (35 inches) wide and about 806 mm (31.75 inches) high.

Typical quench gas flow volumes measured at the entrance of the quench chamber in the inventive system are about 35 to 100 cmm (cubic meters per minute), more preferably, about 55 to 90 cmm, even more preferably, about 60 to 80 cfm. The temperature of the quench gas is typically about 15–25° C. Although the present invention is not limited to particular fiber thicknesses, fiber thicknesses made in the inventive system are typically in the range of about 1.5–5.0 dpf. For a given filament thickness, the temperature and speed of quench gas are typically chosen to quench the filaments over a distance of about 10–20 cm from the face of the spinnerette. Appropriate choices among the variables and parameters may be made, according to the needs of the particular application, by those of ordinary skill in the art. Further, it is within the scope of the present invention to delay the quench step in order to provide an environment in which the filament forms a skin-core structure.

Because of the short spin height in the inventive system, a much smaller amount of the surrounding air is entrained by spinning filaments into the fiber bundle compared to the traditional long spin system. The entrained air usually increases the downdraft along the fiber spinning axis. This downdraft is one of the important elements in the composition of the total spin tension. The shortage of the downdraft in the compact long spin system tends to lower the efficiency of the quench, thus demanding more quench gas, i.e., greater quench gas speed, compared to a system with a longer spin height. At an increased level of quench gas in the compact spin system, many spin breaks occur at the front corner of the spinnerette, thus preventing the achievement of a higher spinning speed. The filament breakage at the corner of the spinnerette is also observed in the long spin system, and these breaks become more frequent when the quench air magnitude becomes higher. Guidance elements according to the present invention serve to reduce filament breakage at the corners of the spinnerette by inducing a more uniform flow of quench gas. A downdraft extension according to the present invention serves to increase quench efficiency permitting use of a lower quench gas flow rate. The reduced quench gas flow rate also serves to decrease spin breakage at the spinnerette corner. Thus, in preferred embodiments, both guidance elements and a downdraft extension cooperate to reduce spin breaks and increase quench efficiency.

The spinning speed of the present process, defined as the speed of the filaments near the take-up roll, is similar to that of a traditional long spin process for polypropylene spinning. Commercial considerations require that spinning be done at as high a rate as possible. Properties of the polymer being spun and the spinning apparatus can influence the upper limit of the spin speed. Those of ordinary skill in the art may select the spin speed to obtain filaments of the chosen denier. Thus, while not a limitation to the invention itself, it is advantageous to employ spin speeds at least about 1,000 m/min and/or less than about 2,200 m/min, for example, about 1,600 m/min.

Fibers without a skin-core structure can be prepared in the inventive system by providing conditions which result in the manufacture of fibers without a skin-core structure. Such conditions may be achieved, for example, by providing an environment that sufficiently avoids oxidation of the surface of the filaments. Such conditions may be selected for use in the present invention.

Fibers with a skin-core structure can be produced in the inventive system by any procedure that achieves an oxidation, degradation and/or lowering of molecular weight of the polymer blend at the surface of the fiber as compared to the polymer blend in an inner core of the fiber. Such a skin-core structure can be obtained, for example, through a delayed quench and exposure to an oxidative environment, as disclosed in U.S. Pat. Nos. 5,431,994, 5,318,735 and 5,281,378, all to Kozulla, and European Application No. 719 879 A2, to Hercules Incorporated, all of which are incorporated above by reference. Another method of obtaining a skin-core structure involves employing a heated spinnerette to achieve thermal degradation of the filament surface, as disclosed in U.S. patent applications Ser. Nos. 08/080,849, 08/378,267, 08/378,271 and 08/378,667 to Takeuchi et al., and European Patent Application No. 0 630 996 to Hercules Incorporated all of which are incorporated above by reference. As discussed in U.S. patent application Ser. No. 08/728,491, to Harrington et al., incorporated by reference as if set forth in its entirety herein, and references therein, the skin-core structure can comprise a skin showing an enrichment of ruthenium staining of at least about 0.2 $\mu$m, more preferably at least about 0.5 $\mu$m, more preferably at least about 0.7 $\mu$m, even more preferably at least about 1 $\mu$m, and even more preferably at least about 1.5 $\mu$m.

With fibers having a denier less than 2 dpf, another manner of stating the ruthenium enrichment is with respect to the equivalent diameter of the fiber, wherein the equivalent diameter is equal to the diameter of a circle with equivalent cross-section area of the fiber averaged over five samples. More particularly, for fibers having a denier less than 2, the skin thickness can also be stated in terms of enrichment in staining of the equivalent diameter of the fiber. In such an instance, the enrichment in ruthenium staining can comprise at least about 1% and up to about 25% of the equivalent diameter of the fiber, preferably about 2% to 10% of the equivalent diameter of the fiber. Still further, the skin-core structure of the instant invention can be determined using a hot stage test, and a skin-core structure is present when a residue trail is present.

The skin-core structure comprises chemical modification of a filament to obtain the skin-core structure, and does not comprise separate components being joined along an axially extending interface, such as in sheath-core and side-by-side bicomponent fibers. Of course, the skin-core structure can be utilized in a composite fiber, such as the skin-core structure being present in the sheath of a sheath-core fiber in the manner disclosed in U. S. Pat. Nos. 5,281,378, 5,318,735 and 5,431,994 and EP Application No. 719 879 A2, which were discussed above and incorporated herein.

Thus, skin-core fibers can be prepared in the inventive system by providing conditions in any manner so that during extrusion of the polymer blend a skin-core structure is formed. For example, the temperature of a hot extrudate, such as an extrudate exiting a spinnerette, can be provided that is sufficiently elevated and for a sufficient amount of time within an oxidative atmosphere in order to obtain the skin-core structure. This elevated temperature can be achieved using a number of techniques, such as disclosed in the above discussed patents to Kozulla, and in U.S. and foreign applications to Takeuchi et al., discussed above and incorporated herein.

For example, skin-core filaments can be prepared in the inventive system through the method of U.S. Pat. Nos. 5,281,378, 5,318,735 and 5,431,994 to Kozulla, and European Patent Application No. 719 879 A2 in which the temperature of the hot extrudate can be provided above at least about 250° C. in an oxidative atmosphere for a period of time sufficient to obtain the oxidative chain scission degradation of its surface. This providing of the temperature can be obtained by delaying cooling of the hot extrudate as it exits the spinnerette, such as by blocking the flow of a quench gas reaching the hot extrudate. Such blocking can be achieved by the use of a shroud or a recessed spinnerette that is constructed and arranged to provide the maintaining of temperature.

In another aspect, as disclosed in U.S. Pat. No. 5,705,119 to Takeuchi et al., and European Patent Application No. 0 630 996, the skin-core structure can be obtained by heating the polymer blend in the vicinity of the spinnerette, either by directly heating the spinnerette or an area adjacent to the spinnerette. In other words, the polymer blend can be heated at a location at or adjacent to the at least one spinnerette, by directly heating the spinnerette or an element such as a heated plate positioned approximately 1 to 4 mm above the spinnerette, so as to heat the polymer composition to a sufficient temperature to obtain a skin-core fiber structure upon cooling, such as being immediately quenched, in an oxidative atmosphere.

In an application of the Takeuchi system to the present invention, for example, the extrusion temperature of the polymer may be about 230° C. to 250° C., and the spinnerette may have a temperature at its lower surface of preferably at least about 250° C. across the exit of the spinnerette in order to obtain oxidative chain scission degradation of the molten filaments to thereby obtain filaments having a skin-core structure. By the use of a heated spinnerette, therefore, the polymer blend is maintained at a sufficiently high temperature that upon extrusion from the spinnerette, oxidative chain scission occurs under oxidative quench conditions.

While the above techniques for forming the skin-core structure have been described, skin-core fibers prepared in the inventive system are not limited to those obtained by the above-described techniques. Any technique that provides a skin-core structure to the fiber is included in the scope of this invention.

Polymers useful with the present invention can comprise various spinnable polymeric materials such as polyolefins and blends comprising polyolefins. Preferably, the polymer is a polypropylene or a blend comprising a polypropylene. The polypropylene can comprise any polypropylene that is spinnable. The polypropylene can be atactic, heterotactic, syndiotactic, isotactic and stereoblock polypropylene—including partially and fully isotactic, or at least substantially fully isotactic—polypropylenes. Polypropylenes which may be spun in the inventive system can be produced by any process. For example, the polypropylene can be prepared using Zeigler-Natta catalyst systems, or using homogeneous or heterogeneous metallocene catalyst systems.

Further, as used herein, the terms polymers, polyolefins, polypropylene, polyethylene, etc., include homopolymers, various polymers, such as copolymers and terpolymers, and mixtures (including blends and alloys produced by mixing separate batches or forming a blend in situ). When referring to polymers, the terminology copolymer is understood to include polymers of two monomers, or two or more monomers, including terpolymers. For example, the polymer can comprise copolymers of olefins, such as propylene, and these copolymers can contain various components. Preferably, in the case of polypropylene, such copolymers can include up to about 20 weight %, and, even more preferably, from about 0 to 10 weight % of at least one of ethylene and butene. However, varying amounts of these components can be contained in the copolymer depending upon the desired fiber.

Further, the polypropylene can comprise dry polymer pellet, flake or grain polymers having a narrow molecular weight distribution or a broad molecular weight distribution, with a broad molecular weight distribution being preferred. The term "broad molecular weight distribution" is here defined as dry polymer pellet, flake or grain preferably having an MWD value (i.e., Wt.Av.Mol.Wt./No.Av.Mol.Wt. measured by SEC as discussed below) of at least about 5, preferably at least about 5.5, more preferably at least about 6. Without limiting the invention, the MWD is typically about 2 to 15, more typically, less than about 10.

The resulting spun melt preferably has a weight average molecular weight varying from about $3\times10^5$ to about $5\times10^5$, a broad SEC molecular weight distribution generally in the range of about 6–20 or above, a spun melt flow rate, MFR, (determined according to ASTM D-1238-86 (condition L;230/2.16), which is incorporated by reference herein in its entirety) of about 13 to about 50 g/10 minutes, and/or a spin temperature conveniently within the range of about 220°–315° C., preferably about 300° C.

Still further, the polypropylene can be linear or branched, such as disclosed by U.S. Pat. No. 4,626,467 to Hostetter, which is incorporated by reference herein in its entirety, and is preferably linear. Additionally, in making the fiber of the present invention, the polypropylene to be made into fibers can include polypropylene compositions as taught in Gupta et al. U.S. Pat. No. 5,629,080, and European Patent Application No. 0 552 013 to Gupta et al., which are incorporated by reference herein in their entireties. Still further, polymer blends such as disclosed in Kozulla, U.S. patent application Ser. No. 08/358,884, filed Dec. 19, 1994, and its continuation Application Ser. No. 08/998,592, filed Dec. 29, 1997 and European Patent Application No. 0 719 879, which are incorporated by reference in their entireties, can also be utilized. Yet further, polymer blends, especially polypropylene blends, which comprise a polymeric bond curve enhancing agent, as disclosed in U.S. patent application Ser. No. 08/728,491, to Harrington et al., incorporated above in its entirety, can also be utilized.

The production of polymer fibers for nonwoven materials usually involves the use of a mix of at least one polymer with nominal amounts of additives, such as antioxidants, stabilizers, pigments, antacids, process aids and the like. Thus, the polymer or polymer blend can include various additives, such as melt stabilizers, antioxidants, pigments, antacids and process aids. The types, identities and amounts of additives can be determined by those f ordinary skill in the art upon consideration of requirements of the product. Without limiting the invention, preferred antioxidants include Irganox 1076, and Irgafos 168 (both from Ciba-Geigy, Tarrytown, N.Y.) which may typically be present in the polymer composition in amounts of about 50–150 ppm (Irganox 1076) or about 200–1000 ppm (Irgafos 168) based on the weight of the total composition. Other optional additives which can be included in the fiber of the present invention include, for example, pigments such as titanium dioxide. typically in amounts up to about 2 weight %, antacids such as calcium stearate, typically in amounts ranging from about 0.01–0.2 weight %, colorants, typically in amounts ranging from 0.01–2.0 weight %, and other additives.

Various finishes can be applied to the filaments to maintain or render them hydrophilic or hydrophobic. Also, one or more components can be included in the polymer blend for modifying the surface properties of the fiber, such as to provide the fiber with repeat wettability, or to prevent or reduce build-up of static electricity. Hydrophobic finish compositions preferably include antistatic agents. Hydrophilic finishes may also include such agents.

Preferable hydrophobic finishes include those of U.S. Pat. No. 4,938,832, European Patent Application No. 486,158, all to Schmalz, which are incorporated by reference as if set forth in their entireties herein. These documents describe fiber finish compositions containing at least one neutralized phosphoric acid ester having a lower alkyl group, such as a 1–8 carbon alkyl group, which functions as an antistat, in combination with polysiloxane lubricants.

Another hydrophobic finish composition that can be used with the present invention is disclosed in U.S. Pat. No. 5,403,426, to Johnson et al., incorporated by reference as if set forth in its entirety herein. This patent describes a method of preparing hydrophobic fiber for processing inclusive of crimping, cutting, carding, compiling and bonding. The surface modifier comprises one or more of a class of water soluble compounds substantially free of lipophilic end groups and of low or limited surfactant properties.

Yet another hydrophobic finish composition that can be used with the present invention is disclosed in U.S. patent application Ser. No. 08/728,490, filed Oct. 9, 1996, to Hirwe et al., which is incorporated by reference as if set forth in its entirety herein. The hydrophobic finish compositions of this document comprise hydrophobic esters of pentaerythritol homologs, preferably hydrophobic esters of pentaerythritol and pentaerythritol oligomers. Finish compositions comprising such a lubricant may further comprise other lubricants, anti-static agents, and/or other additives.

Further, U.S. Pat. No. 5,540,953, to Harrington, incorporated by reference as if set forth in its entirety herein, describes antistatic compositions useful in the preparation of hydrophobic fibers and nonwoven fabrics. One finish described therein comprises 1) at least one neutralized $C_3$–$C_{12}$ alkyl or alkenyl phosphate alkali metal or alkali earth metal salt, and 2) a solubilizer. A second finish described therein comprises at least one neutralized phosphoric ester salt.

Other ingredients that may comprise a finish composition useful with the present invention include emulsifiers or other stabilizers, and preservatives such as biocides. One preferred biocide is Nuosept® 95, 95% hemiacetals in water, available from Nuodex Inc. division of HULS America Inc. (Piscataway, N.J.).

Finish compositions comprising hydrophilic finishes or other hydrophobic finishes. may be selected by those of ordinary skill in the art according to the characteristics of the apparatus and the needs of the product being manufactured. Other additives such as antistatic agents, stabilizers, emulsifiers and preservatives may be similarly selected.

EXAMPLES

The invention generally described above is now further described with the following Examples. These Examples are meant to be illustrative of some embodiments of the invention, but are not meant to limit the invention in any way. Other embodiments, both as apparent to those in the art and as described above, are included in this invention, which is limited only by the claims. Unless otherwise noted, parts and percentages, etc., are by weight.

Test Methods

In the following Examples, fibers are prepared in accordance with the present invention and formed into nonwoven fabrics. These fibers and fabrics are compared with non-inventive fiber and fabrics made therefrom. The structures of the fibers are determined through wide angle X-ray spectroscopy (WAX) and differential scanning calorimeter (DSC). The fibers are also tested for thermal shrinkage through Thermal Mechanical Analysis (TMA). The nonwoven fabrics are tested for cross-directional strength and percent elongation at point of breakage. These procedures are now presented in detail.

Size Exclusion Chromatography:

Size exclusion chromatography (SEC) is used to determine the molecular weight distribution. In particular, high performance size exclusion chromatography is performed at a temperature of 145° C. using a Waters 150-C ALC/GPC high temperature liquid chromatograph with differential refractive index (Waters) detection. To control temperature, the column compartment, detector, and injection system are thermostatted at 145° C., and the pump is thermostatted at 55° C. The mobile phase employed is 1,2,4-trichlorobenzene (TCB) stabilized with butylated hydroxytoluene (BHT) at 4 mg/L, with a flow rate of 0.5 ml/min. The column set includes two Polymer Laboratories (Amherst, Mass.) PL Gel mixed-B bed columns, 10 micron particle size, part no. 1110–6100, and a Polymer Laboratories PL-Gel 500 angstrom column, 10 micron particle size, part no. 1110–6125. To perform the chromatographic analysis, the samples are dissolved in stabilized TCB by heating to 175° C. for two hours followed by two additional hours of dissolution at 145° C. Moreover, the samples are not filtered prior to the analysis. All molecular weight data is based on a polypropylene calibration curve obtained from a universal transform of an experimental polystyrene calibration curve. The universal transform employs empirically optimized Mark-Houwink coefficients of K=0.0152 and $\alpha$=0.72 for polypropylene.

Wide Angle X-Ray Spectroscopy (WAX):

WAX may be used to determine the relative amounts of amorphous, smectic and crystalline (monoclinic) phases in polypropylene filament fiber (spun yarn) and staple fiber. Spin yarn samples are hand wound and staple fiber samples are cut to 0.5 mm lengths. The samples are then packed to a thickness of 2 mm and placed into a sample holder for analysis. The sample is exposed to X-rays generated by a copper anode X-ray tube operated at 1800 watts (40 mA and 45 kV). The samples are scanned from 7 to 32 degrees 2$\theta$ at 0.5 degrees/min for spin yarn and 0.25 degrees per minute for staple fiber.

After completion of the scan, the data are analyzed to determine the percent levels of monoclinic, smectic and amorphous phases by comparing the sample X-ray spectrum with known spectra for each of the three phases.

Differential Scanning Calorimeter (DSC):

As indicated above, one means of determining crystallinity content of polyolefin fibers utilizes differential scanning calorimeter (DSC). In particular, a Dupont DSC 2910 differential scanning calorimeter module with a Dupont Thermal Analyst TA 2000 was used to make the measurements. The temperature was calibrated using an Indium standard. The instrument and its general operation are described in the DSC 2910 Operator's Manual. published 1993 by TA Instruments, 109 Lukens Drive, New Castle, Del. 19720.

A sample of fiber is cut up, placed in the calorimeter pan and heated at a constant rate of 2.0° C./min. The energy required to melt the sample is measured as the area under the melting endotherm. The energy required to melt the same mass of 100% crystalline polypropylene is known and compared with the energy required to melt the sample.

TMA Shrinkage:

The Thermal Mechanical Shrinkage (TMA) was measured by heating the fibers gradually and measuring their shrinkage at a sequence of predetermined temperatures. A fiber that is subject to less cold draw during spinning, or that has lower crystallinity, typically exhibits a lower TMA shrinkage than a fiber subject to greater cold draw or having greater crystallinity.

In order to assure precision, a mass of uncrimped fiber or spin yarn (milligrams) equal to 0.847 times the staple length is weighed and tested. The sample of fiber is mounted with Duco® cement between aluminum pins spaced 0.300 inches apart. A 10 g weight is suspended from one end of the sample before cementing to obtain uniform tension among samples. The mounted sample is placed in a thermal mechanical analyzer equipped with an X,Y plotter. A Dupont Instruments Model TMA 2940 or its equivalent may be used. Once in the analyzer, the sample is put under a load of 300 mg. Helium flow rate is set to 10 ml/min, and the temperature program is set at an initial temperature of 80° C., a final temperature of 180° C., and a rate of increase of 10° C./min. The thermocouple is fixed at the center of the sample, and ⅛ inch from the sample surface. The analysis is carried out on two samples from the same batch of fiber, and the average of the results are reported at 120°, 130°, 140° and 150° C. If the individual values do not agree to within 0.045%, the run is repeated.

Hot Stage Microscope Analysis:

The inventive process may be used to manufacture fibers with skin-core structure. A test procedure to illustrate skin-core structure of fibers, and especially useful in evaluating the ability of a fiber to thermally bond, consists of the microfusion analysis of residue using a hot stage test. This procedure is used to examine for the presence of a residue following axial shrinkage of a fiber during heating, with the presence of a higher amount of residue directly correlating with the ability of a fiber to provide good thermal bonding. In this hot stage procedure, a suitable hot stage, such as a Mettler FP82 HT low mass hot stage controlled via a Mettler FP90 control processor, is set to 145° C. A drop of silicone oil is placed on a clean microscope slide. Approximately 10 to 100 fibers are cut into ½ mm lengths from three random areas of filamentary sample, and stirred into the silicone oil with a probe. The randomly dispersed sample is covered with a cover glass and placed on the hot stage, so that both ends of the cut fibers will, for the most part, be in the field of view. The temperature of the hot stage is then raised at a rate of 3° C./minute. At some temperature, the fibers shrink axially, and the presence or absence of trailing residues is observed. As the shrinkage is completed, the heating is stopped, and the temperature is reduced rapidly to 145° C. The sample is then examined through a suitable microscope, such as a Nikon SK-E trinocular polarizing microscope, and a photograph of a representative area is taken to obtain a still photo reproduction using, for example, a MTI-NC70 video camera equipped with a Pasecon videotube and a Sony Up-850 B/W videographic printer. A rating of "excellent" is used when substantially all of the fibers leave residues. A rating of "good" is used when the majority of fibers leaves residues. A rating of "poor" is used when only a few percent of the fibers leave residues. Other comparative ratings are also available, and include a rating of "fair" which falls between "good" and "poor," and a rating of "none" which, of course, falls below "poor." A rating of "none" indicates that a skin is not present, whereas ratings of "poor" to "excellent" indicate that a skin is present.

Normalized Cross-Directional Strength and Elongation:

Test strips (six per sample) of each nonwoven, 1 inch×7 inches (25 mm×178 mm) are tested using a tensile tester Model 1122 from Instron Corporation, Canton, Mass. for cross-directional (CD) strength and elongation.

Specifically, the breaking load and elongation are determined in accordance with the "cut strip test" in ASTM D-1682-64 (Re-approved 1975), which is incorporated by reference in its entirety, using the Instron Tester set at constant rate of traverse testing mode. The gauge length is 12.7 cm, the crosshead speed is 12.7 cm/minute, and the extension rate is 100%/minute.

Example I

Polypropylene (molecular weight distribution 4.5–5.2; bimodal nominal MFR 9.5–10.5 g/10 min) available as Pro-Fax from (Montel, Wilmington, Del.), was mixed with 0.1% Irgafos 168 (Ciba-Geigy Corp., Tarrytown, N.Y.) in an impact blender. After thorough blending, the mixture was fed into a 2.5 inch extruder, melted and spun through two 2843 hole spinnerettes (Wetzel, Sisseln, Switzerland), having circular cross-section, counter bored, countersunk capillaries 35 mm high, with outlets about 0.36 mm in diameter. The extruder temperature was kept at about 300° C. and the extrusion pressure was $13.1\times10^6$ Pa. The spin head temperature was 303° C. and the beam pressure was $2.7\times10^6$ Pa. The spin head temperature was kept constant by adjusting the extruder temperature and pressure settings. The spin pump was run at a rate of 19.2 rpm.

The spin height was about 2 m. No guidance wings or downdraft extension was used.

The quench box was about 889 mm (35 inches) wide and about 806 mm (31.75 inches) high. A shroud about 30 mm (1.2 inches) high was positioned between the spinnerettes and the blow box in order to delay the quench and impart a skin-core structure to the filament. Air at 21.1° C. was used as the quench gas, and was blown at a rate of 75.6 cmm, which corresponds to an average speed of about 106.6 m/min, at the entrance of the quench box. The exhaust at the quench box exit was operated at a setting of about 20 mm (0.80 inches) of water.

The fiber bundle was passed over a kiss roll which was partially immersed in a tank of spin finish composition at 49° C. The kiss roll was located 1.24 m from the spinnerette. The spin finish was prepared by mixing 7.5% (active ingredients) Lurol® PP912 (George A. Goulston Co. Inc., Monroe, N.C.) and 0.1% of a biocide (Nuosept® 95, 50% hemiacetals in water, Nuodex Inc. division of HULS America Inc., Piscataway, N.J.) with water to 100% to provide a 7.5% concentration of active (non-aqueous) ingredients. Lurol® PP912 is a hydrophilic finish composition which is a blend of fatty acid ethoxylates, hydroxyethylamines and alkyl phosphates. The contact between the fiber and the kiss roll was of sufficient duration and speed to apply about 1–2 weight percent of the finish based on the dry weight of the fiber. Fiber spin speed was 1055 m/min.

The spun fiber was 2.2 dpf, had an average melt flow rate of 37.9 g/10 mm and showed excellent hot stage microscope analysis.

The fibers were crimped, cut and made into nonwoven fabrics as described in U.S. patent application Ser. No. 08/728,491, filed Nov. 6, 1996, to Harrington et al., incorporated above by reference. Specifically, after passing over the take-up roll, the filament was collected in circular cans 0.8 m diameter×1.1 m high. The fiber bundle was pulled out of ten cans into draw strands, which were collectively drawn using a mechanical draw ratio of 1.35× and septet roll temperature conditions of 60° C. and 90° C. The drawn tow was crimped at 79.9 crimps/10 cm (20.3 crimps/inch) using a stuffer box with steam. At the spinning and crimping steps, the fiber was coated with an overfinish mixture (0.65% by weight finish on fiber). The overfinish was applied to the crimped tow with a slot bar which had the finish composition (99.9% Lurol PP912 and 0.1% Nuosept® 95) running through. The crimped fiber was cut to staple of about 1.5 inches (38 mm) length.

Fibers of each blend composition are then carded into conventional fiber webs at 250 feet per minute (76 m/min) using equipment and procedures as discussed in Legare, R. J., 1986 *TAPPI Synthetic Fibers for Wet System and Thermal Bonding Applications*, Boston Park Plaza Hotel & Towers, Boston Mass. Oct 9–10, 1986, "Thermal Bonding of Polypropylene Fibers in Nonwovens", pages 1–13, 57–71 and attached Tables and Figures. The Webmaster® randomizers described in the TAPPI article were not used. This article is incorporated herein in its entirety, by reference thereto.

Specifically, two layers of the carded staple fibers are stacked in the machine direction, and bonded using a diamond design embossed calender roll and a smooth roll at roll temperatures ranging from about 145 to 170° C. and roll pressures of 420 Newtons per linear centimeter (240 pounds per linear inch) to obtain nonwovens weighing nominally about 23.9 grams per square meter (20±1 grams per square yard). The diamond pattern calender roll has a 15% land area, 58.1 spots/sq.cm. with a depth of 0.076 cm. Further, the diamonds had a width of 0.101 cm, a height of 0.051 cm, and are spaced height-wise 0.22 cm on center, and width-wise 0.152 cm on center.

The fabric was tested for cross and machine direction tensile strength measurements using the ASTM procedure presented above. Fabric uniformity was tested using image analysis.

Example IIa

Fiber was prepared as in Example I with the following changes. Polypropylene (MWD 4.5–5.5; bimodal nominal MFR 9.5–10.5 g/10 min) available as Profax® (Indelpro, Altamira, Mexico), was mixed with additives as in Example I. Better control over the melt temperature in the spin head, just above the spinnerette, was achieved by reducing the extrusion end pressure to about $10.43\times10^6$ Pa. The beam pressure was $2.45\times10^6$ Pa, indicating a more degraded polymer than Example I.

The spin pump was operated at a rate of 19.2 rpm and required quench air flow rate of 70.8 cmm or greater. The exhaust at the quench box exit was operated at a setting of about 22 mm (0.85 inches) of water.

In this run, the spin speed was initially 1055 m/min. The spin speed was gradually increased until a speed of 1450 m/min was reached, at which point spin continuity was lost as filament breakage occurred.

The spun fiber was 2.4 dpf, had an average melt flow rate of 40.0 g/10 min and showed fair to good hot stage microscope analysis.

Example IIb

Fiber was prepared as in Example IIa with the following changes. The spin pump was operated at a rate of 30.0 rpm and required quench air flow rate of 84 cmm or greater. The exhaust at the quench box exit was operated at a setting of about 20 mm (0.80 inches) of water. The shroud height was 1.0 inches (2.54 cm).

In this run, the spin speed was initially 1079 m/min. The spin speed was gradually increased until a speed of 1210 m/min was reached, at which point spin continuity was lost.

The spun fiber was 3.0 dpf and had an average melt flow rate of 28.0 g/10 min.

Example III

Fiber was prepared as in Example I with the following changes.

Each position of spinnerettes was equipped with a pair of wings about 127 mm (5 inches) high, with straight portions about 159 mm (6.25 inches) long, deflector portions (straight) about 59 mm (2.3 inches) long, and deflector angles of about 30°. The shroud overlapped about the top 30 mm (1.2 inches) of the wings. Further, the exhaust system was equipped with a plexiglass exhaust extension about 102 mm (4 inches) high, and set to a downdraft extension angle of about 45°.

The spin pump was run at a rate of 30.0 rpm for 3.0 dpf filament. The line speed was 1210 m/min. The quench gas was air blown at 64.4 cmm, and the exhaust was operated at a pressure of about 38 mm (1.5 inches) of water.

Spin continuity was excellent. Filament MFR was 29.9 g/10 min.

Example IV

Fiber was prepared as in Example III with the following changes. The spin pump was run at a rate of 30.0 rpm for 2.4 dpf filament. The line speed was 1500 m/min. The quench gas was air blown at 60.2 cmm.

Filament MFR was 29.0 g/10 min.

Example V

Fiber was prepared as in Example III with the following changes. The spin pump was run at a rate of 33.0 rpm for 3.0 dpf filament. The line speed was 1331 m/min. The quench gas was air blown at 70 cmm.

Example VI

Fiber was prepared as in Example III with the following changes. The spin pump was run at a rate of 35.0 rpm for 3.0 dpf filament. The line speed was 1412 m/min. The quench gas was air blown at 85.4 cmm.

Control

For purposes of comparison, a fiber prepared as follows was used as a control.

A dry melt spun composition was prepared by tumble mixing isotactic polypropylene flake (crystallinity 53%, $M_w$=300,000, molecular weight distribution 5.0–6.0, melt flow rate 9.5±1.0 g/10 min) with about 0.1% Irgafos® 168 (Ciba-Geigy, Tarrytown, N.Y.) as a stabilizer. The mix was then heated and spun as circular cross section fiber at a temperature of about 300° C. under a nitrogen atmosphere using a standard 3125 spinnerette at a spin speed of 1100 m/min. The fiber thread lines in the quench box are exposed to a normal ambient air quench (cross blow) with about 5.4% of the upstream jets in the quench box blocked off to delay the quenching step. The spin height for this run was about 5.6 m.

After quenching, spin finish application and further processing were done in a similar manner to Example I.

Results

Results of the WAX and DSC tests for crystallinity run on the spin yarns, those yarns collected after passing the take-up roll without further processing, of the above Examples are presented in Table 1, below. The TMA shrinkages for the spin yarns at several temperatures are reported in Table 2.

TABLE 1

| | WAX Spin Yarn Structure (percent) | | | DSC Spin Yarn Crystallinity |
|---|---|---|---|---|
| | smectic | crystalline | amorphous | (percent) |
| control | 31 | 41.1 | 27.9 | 54.28 |
| Example I | 34.8 | 36.8 | 28.3 | 50.7 |
| Example IIa | 36.8 | 35.5 | 27.7 | 53.73 |

TABLE 2

| | Spin Yarn TMA Shrinkage (percent) | | | |
|---|---|---|---|---|
| | 120° C. | 130° C. | 140° C. | 150° C. |
| control | 3.415 | 3.845 | 4.368 | 4.997 |
| Example I | 2.742 | 2.889 | 3.006 | 2.975 |
| Example IIa | 2.422 | 2.646 | 2.898 | 3.091 |

Figure 6A:
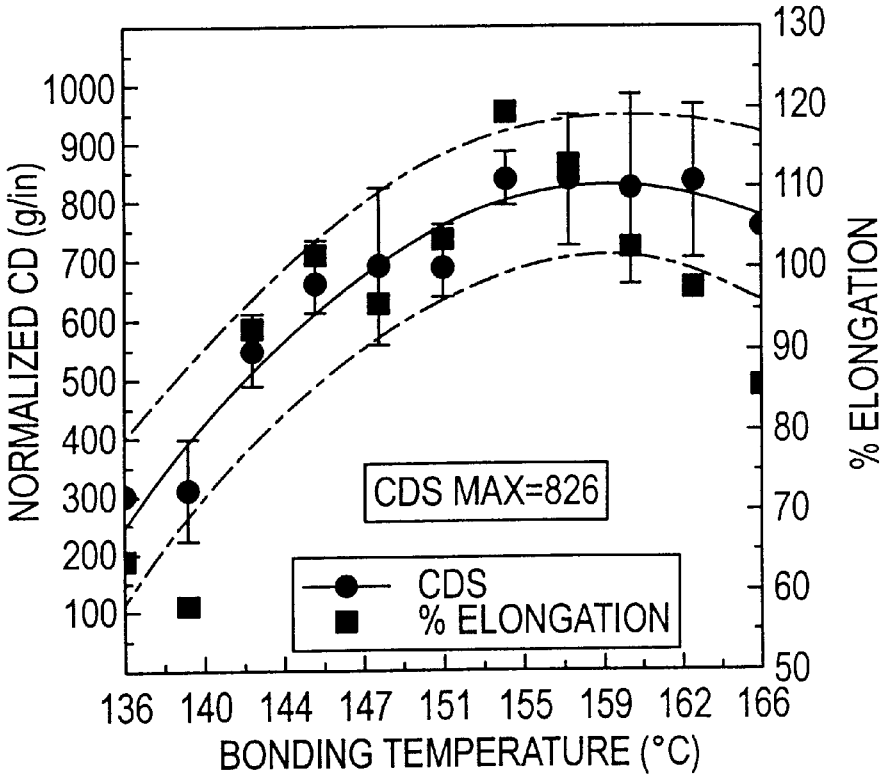
FIGS. 6*a* and 6*b* present graphs of normalized cross-directional strengths and elongations, as functions of bonding temperature, of fabrics prepared herein.
Figure 6B:
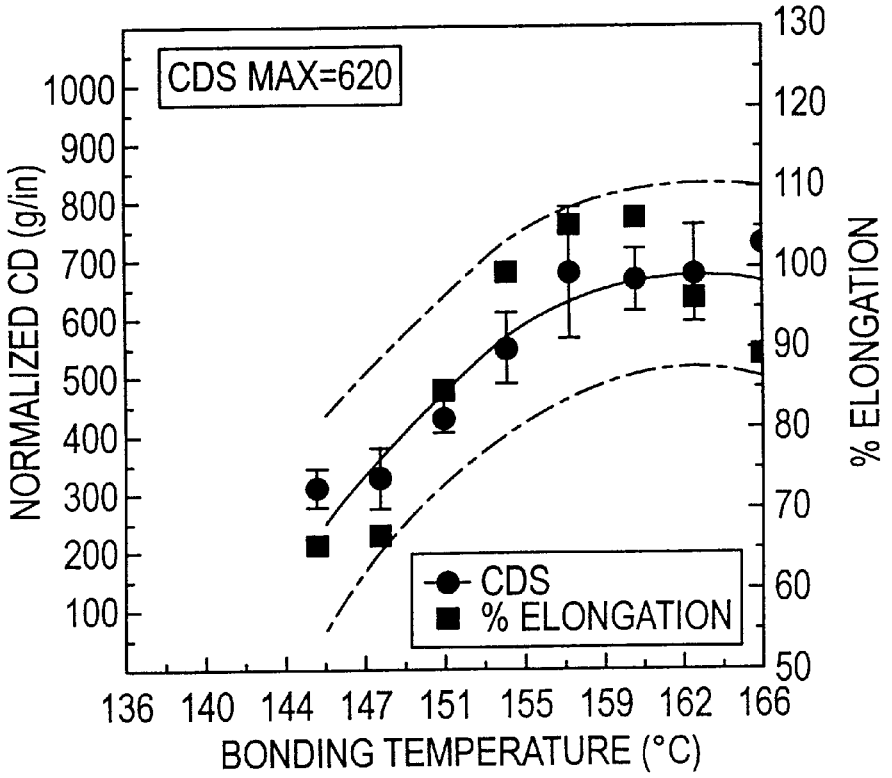

FIG. 6*a* shows the normalized cross-directional strength and % elongation of a nonwoven fabric, prepared as described above from the fiber of Example I, as a function of bonding temperature. FIG. 6*b* is similar to FIG. 6*a*, but is for a nonwoven fabric prepared from a fiber of the Control example. The fabrics produced according to Example I exhibited higher maximum normalized CD strength and greater elongation compared to fabrics prepared according the Control example.

Table 3 presents comparative data on the above runs. The throughput is presented in terms of spin pump rpm, with higher values representing higher throughput.

TABLE 3

| Example | throughput (pump rpm) | spin speed (m/min) | spin yarn MFR (g/10 min) | spin continuity | quench gas flow (cfm) |
|---|---|---|---|---|---|
| I | 19.2 | 1055 | 37.9 | excellent | 75.6 |
| IIa | 19.2 | 1055 | 40.0 | lost at 1450 m/min spin speed | 70 |
| IIb | 30 | 1210 | 28.0 | lost at 1210 m/min spin speed | >84 |
| III | 30 | 1210 | 29.9 | excellent | 64.4 |
| IV | 30 | 1500 | 29.0 | excellent | 60.2 |
| V | 33 | 1331 | | excellent | 70 |
| VI | 35 | 1412 | | excellent | 85.4 |

Thus, it can be seen that for the same throughput and spin height of Example IIb, utilization of guidance wings and downdraft extension (Examples III and IV) permitted use of a lower quench gas flow rate and as high or higher spin speeds, while exhibiting improved spin continuity. Further, the use of shortened spin height, guidance wings and downdraft extension, permitted higher spin speed and throughput, while maintaining spin continuity.

It should be noted that in the process illustrated in the above Examples, the smectic content of the fiber increased essentially at the expense of crystalline content. In general, however, the smectic content may also be increased essentially at the expense of amorphous phase, or at the expense of a combination of both amorphous phase and crystalline structure.

Although the invention has been described with reference to particular means, materials and embodiments, it is to be understood that the invention is not limited to the particulars disclosed and extends to all equivalents within the scope of the claims.

We claim:

1. A process for spinning polyolefin filament comprising:

extruding a polyolefin-containing composition through at least one spinnerette to form at least one molten extrudate, quenching said at least one molten extrudate to form at least one filament, and passing said at least one filament over a take-up roll, at a spin height of about 1 to 4 meters, at a spinning speed of at least about 500 m/min.

2. The process of claim 1 wherein said spin height is about 1.5 to 3 meters.

3. The process of claim 2 wherein said spin height is about 1.8 to 2.5 meters.

4. The process of claim 3 wherein said spin height is about 2 meters.

5. The process of claim 2 wherein said quenching includes directing a quench gas toward a first side of said at least one spinnerette, said quench gas comprising an oxidative gas capable of oxidizing said at least one molten extrudate, so as to effect oxidative chain scission degradation of at least the surface of said at least one molten extrudate to form at least one filament with a skin-core structure.

6. The process of claim 1 wherein said at least one spinnerette comprises a first side and an oppositely disposed second side, and said quenching includes directing a quenching gas toward said first side.

7. The process of claim 6 which further comprises at least two guidance elements associated with said at least one spinnerette.

8. The process of claim 7 wherein said at least two guidance elements comprise guidance elements associated with opposing lateral sides of said at least one spinnerette.

9. The process of claim 8 wherein said at least one spinnerette comprises a plurality of spinnerettes, and said at least two guidance elements include a guidance element associated with each of outermost sides of said plurality of spinnerettes.

10. The process of claim 9 wherein said plurality of spinnerettes comprises two spinnerettes.

11. The process of claim 8 wherein said at least two guide elements comprise leading ends and trailing ends, said leading ends being substantially planar.

12. The process of claim 11 wherein said trailing ends comprise deflector portions.

13. The process of claim 12 wherein said deflector portions are substantially planar and are directed inward at deflector angles of about 10° to 60°.

14. The process of claim 13 wherein said deflector angles are about 30°.

15. The process of claim 2 wherein said spinning speed is about 1,000 to 2,200 m/min.

16. The process of claim 15 wherein said spinning speed is about 1,600 m/min.

17. The process of claim 5 wherein said quench gas has a flow speed of about 30 to 215 m/min at said first side of said at least one spinnerette.

18. The process of claim 17 wherein said flow speed is about 60 to 155 m/min.

19. The process of claim 18 wherein said flow speed is about 90 to 125 m/min.

20. The process of claim 6 wherein said quenching gas comprises an oxidative gas capable of oxidizing said at least one molten extrudate so as to effect oxidative chain scission degradation of at least the surface of said at least one molten extrudate.

21. The process of claim 20 which further comprises a shroud associated with at least said first side of said at least one spinnerette.

22. The process of claim 6 which further comprises a downdraft extension associated with said second side of said at least one spinnerette.

23. The process of claim 22 which further comprises an exhaust unit for removing a portion of said quench gas, said downdraft extension being associated with said exhaust unit.

24. The process of claim 23 wherein said downdraft extension is substantially planar.

25. The process of claim 23 wherein said downdraft extension is inwardly directed at an exhaust extension angle of about 10° to 70°.

26. The process of claim 25 wherein said downdraft extension angle is about 45°.

27. The process of claim 6 which further comprises at least two guidance elements associated with said at least one spinnerette and a downdraft extension associated with said second side of said at least one spinnerette.

28. The process of claim 27 wherein said at least two guidance elements comprise guidance elements positioned on opposite sides of said at least one spinnerette, and which further comprises an exhaust unit for removing a portion of said quench gas, said downdraft extension being associated with said exhaust unit.

29. The process of claim 28 wherein said at least one spinnerette comprises a plurality of spinnerettes, and said at least two guidance elements include guidance elements positioned on opposite sides of said plurality of spinnerettes.

30. The process of claim 29 wherein said plurality of spinnerettes comprises two spinnerettes.

31. The process of claim 30 wherein said at least two guide elements comprise leading ends and trailing ends, said leading ends being substantially planar, and said downdraft extension is substantially planar.

32. The process of claim 31 wherein said trailing ends comprise deflector portions.

33. The process of claim 32 wherein said deflector portions are substantially planar and are directed inward at deflector angles of about 10° to 60° and said downdraft extension is inwardly directed at an exhaust extension angle of about 10° to 70°.

34. The process of claim 33 wherein said spin height is about 1.5 to 3 meters.

35. The process of claim 34 wherein said spin height is about 1.8 to 2.5 meters.

36. The process of claim 35 wherein said spin height is about 2 meters.

37. The process of claim 35 wherein said quenching includes directing a quench gas toward a first side of said at least one spinnerette, said quench gas comprising an oxidative gas capable of oxidizing said at least one molten extrudate, so as to effect oxidative chain scission degradation of at least the surface of said at least one molten extrudate to form at least one filament with a skin-core structure.

38. A process for spinning polyolefin filament comprising:

extruding a polyolefin-containing composition through at least one spinnerette to form at least one molten extrudate, quenching said at least one molten extrudate to form at least one filament, and passing said at least one filament over a take-up roll, at a spin height of less than about 3 meters, at a spinning speed of at least about 500 m/min.

39. The process of claim 1 wherein said polyolefin-containing composition comprises polypropylene.

40. The process of claim 39 wherein said spinning speed is about 1,000 to 2,200 m/min.

41. The process of claim 40 wherein said spinning height is about 1.5 to 3 meters.

42. The process of claim 41 which further comprises at least two guidance elements associated with said at least one spinnerette.

43. The process of claim 42 wherein said at least one spinnerette comprises a first side and an oppositely disposed second side, said quenching includes directing a quenching gas toward said first side, and which further comprises a downdraft extension associated with said second side.

44. The process of claim 5 wherein said polyolefin-containing composition comprises polypropylene.

45. The process of claim 15 wherein said polyolefin-containing composition comprises polypropylene.

46. The process of claim 17 wherein said polyolefin-containing composition comprises polypropylene.

47. The process of claim 20 wherein said polyolefin-containing composition comprises polypropylene.

* * * * *